US007455008B2

(12) United States Patent
Kurita et al.

(10) Patent No.: US 7,455,008 B2
(45) Date of Patent: Nov. 25, 2008

(54) SWASH PLATE COMPRESSOR

(75) Inventors: Hajime Kurita, Kariya (JP); Takayuki Imai, Kariya (JP); Masakazu Murase, Kariya (JP); Masaki Ota, Kariya (JP); Tetsuhiko Fukanuma, Kariya (JP); Takeshi Yamada, Kariya (JP)

(73) Assignee: Kabushiki Kaisha Toyota Jidoshokki, Kariya-Shi (JP)

( * ) Notice: Subject to any disclaimer, the term of this patent is extended or adjusted under 35 U.S.C. 154(b) by 88 days.

(21) Appl. No.: 10/570,470

(22) PCT Filed: Aug. 6, 2004

(86) PCT No.: PCT/JP2004/011374

§ 371 (c)(1),
(2), (4) Date: Sep. 29, 2006

(87) PCT Pub. No.: WO2005/024234

PCT Pub. Date: Mar. 17, 2005

(65) Prior Publication Data

US 2007/0039459 A1 Feb. 22, 2007

(30) Foreign Application Priority Data

Sep. 2, 2003 (JP) ..... 2003-310290
Sep. 18, 2003 (JP) ..... 2003-326962

(51) Int. Cl.
*F01B 3/02* (2006.01)

(52) U.S. Cl. ..... 92/12.2

(58) Field of Classification Search ..... 92/12.2, 92/71

See application file for complete search history.

(56) References Cited

U.S. PATENT DOCUMENTS 5,983,775 A 11/1999 Fukai

FOREIGN PATENT DOCUMENTS

| | | | |
|---|---|---|---|
| JP | 3-141877 | | 6/1991 |
| JP | 5-195950 | | 8/1993 |
| JP | 8-28447 | | 1/1996 |
| JP | 08028447 A | * | 1/1996 |
| JP | 8-338363 | | 12/1996 |
| JP | 9-105376 | | 4/1997 |
| JP | 10-196525 | | 7/1998 |
| JP | 2001-32768 | | 2/2001 |
| JP | 2002-180955 | | 6/2002 |

* cited by examiner

*Primary Examiner*—F. Daniel Lopez
(74) *Attorney, Agent, or Firm*—Morgan & Finnegan, LLP

(57) ABSTRACT

A first swash plate 18 is coupled to a drive shaft 16 to be rotatable integrally with the drive shaft 16. Single head pistons 23 are coupled to the first swash plate 18 via shoes 25A, 25B. Rotation of the drive shaft 16 rotates the first swash plate 18, which causes the pistons 23 to reciprocate and compress refrigerant gas. The first swash plate 18 supports an annular second swash plate 51 to be rotatable relative to the first swash plate 18 via a ball bearing 52. The second swash plate 51 is arranged between the first swash plate 18and the shoes 25B that receive a compressive load to be slidable with respect to the first swash plate 18 and the shoes 25B. Therefore, the first swash plate reliably slides with respect to the second swash plate.

15 Claims, 10 Drawing Sheets

SWASH PLATE COMPRESSOR

FIELD OF THE INVENTION

The present invention relates to a swash plate compressor that forms, for example, part of a refrigeration circuit and compresses refrigerant gas.

BACKGROUND OF THE INVENTION

A variable displacement swash plate compressor used for a refrigeration circuit as shown in FIG. 11 has been proposed in the prior art. That is, a drive shaft 91 is rotatably supported by a housing 85, and a rotor 87 is fixed to the drive shaft 91 to be rotatable integrally with the drive shaft 91. A swash plate 92 is supported by the drive shaft 91 to be slidable in the direction of the axis L and tiltable with respect to the drive shaft 91. A hinge mechanism 88 is located between the rotor 87 and the swash plate 92. Single head pistons 94 are coupled to the outer circumferential portion of the swash plate 92 with semispherical first shoes 93A arranged toward the hinge mechanism 88 and semispherical second shoes 93B arranged opposite to the hinge mechanism 88. When the swash plate 92 is rotated by rotation of the drive shaft 91, the swash plate 92 slides with respect to the shoes 93A, 93B causing the pistons 94 to reciprocate, thereby compressing refrigerant gas.

The shoes 93A, 93B rotate about an axis S (a line that passes through the center of curvature P of semispherical sliding surfaces 93*a* and is perpendicular to sliding flat surfaces 93*b* with respect to the swash plate 92) as the shoes 93A, 93B rotate relative to the swash plate 92. The rotation of the shoes 93A, 93B about the axis S is caused because a rotational force is applied to the shoes 93A, 93B in one direction about the axis S due to the difference between the circumferential velocities of the inner and outer circumferences of the swash plate 92. More specifically, the circumferential velocity of the outer circumference of the swash plate 92 is greater than that of the inner circumference of the swash plate 92.

That is, the swash plate compressor shown in FIG. 11 is configured such that the shoes 93A, 93B directly slide against the swash plate 92. Therefore, the shoes 93A, 93B are unnecessarily rotated about the axis S due to the sliding motion caused as the shoes 93A, 93B rotate relative to the swash plate 92. This increases the mechanical loss particularly at the sliding portion between each piston 94 and the corresponding shoe 93B that receives reactive force of compression, and causes problems such as seizure at the sliding portions.

To solve these problems, it has been proposed to provide a roller bearing that receives a thrust load between the swash plate 92 and the shoes 93B [For example, Japanese Laid-Open Patent Publication No. 8-28447 (page 3, FIG. 1)]. In this case, as rolling elements of the roller bearing roll, the swash plate 92 slides with respect to the shoes 93B. This suppresses rotation motion of the shoes 93B about the axis S caused by relative rotation between the swash plate 92 and the shoes 93B. Therefore, the mechanical loss and occurrence of problems are suppressed.

However, when the swash plate 92 and the roller bearing are located in the limited space between the shoes 93A and the shoes 93B, the swash plate 92 is made thin and a predetermined strength may not be secured. Also, as for the piston 94 located in the vicinity of the top dead center position (in the compression stroke), a load from the shoe 93B that receives a significant reaction force of compression is concentrated on a particular rolling element of the roller bearing. Therefore, the durability of the rolling elements of such a small size that they can be arranged in the limited space between the shoes 93A and the shoes 93B (in other words, with low strength) may not be sufficient.

To solve such a problem, for example, a technique as shown in FIG. 12 has been proposed [for example, Japanese Laid-Open Patent Publication No. 8-338363 (page 4, FIG. 1)]. That is, an annular step 90*a* is provided at the center of a rear surface (a surface facing rightward in FIG. 12) of a first swash plate 90. An annular second swash plate 95 is arranged outward of the step 90*a* of the first swash plate 90. The second swash plate 95 is supported by the first swash plate 90 via a support hole 95*a* formed at the center of the second swash plate 95 to be rotatable relative to the first swash plate 90. The outer circumferential portion of the second swash plate 95 is arranged between the first swash plate 90 and the shoes 93B to be slidable with respect to the first swash plate 90 and the shoes 93B.

Therefore, when the first swash plate 90 is rotated, the first swash plate 90 slides relative to the second swash plate 95, which reduces the rotation speed of the second swash plate 95 as compared to the rotation speed of the first swash plate 90. This reduces the relative rotation speed of the second swash plate 95 and the shoes 93B (the relative rotation speed of the second swash plate 95 with respect to the shoes 93B) as compared to the relative rotation speed of the shoes 93B and the first swash plate 90 (the relative rotation speed of the first swash plate 90 with respect to the shoes 93B). As a result, the rotation of each shoe 93B about the axis S caused by the relative rotation of the second swash plate 95 and the shoes 93B is suppressed, which suppresses mechanical loss and occurrence of problems. Also, the second swash plate 95, which is a thin plate, is merely located between the shoes 93B and the first swash plate 90. This secures the thickness (or the strength) of the first swash plate 90, and a load from the shoe 93B of the piston 94 located in the vicinity of the top dead center position (in the compression stroke) that receives a significant reaction force of compression is dispersed and received by a large area of the second swash plate 95. Therefore, the durability of the second swash plate is sufficient.

However, when the first swash plate 90 is rotated, frictional resistance occurs between the inner circumferential surface of the support hole 95*a* of the second swash plate 95 and the first swash plate 90 (the step 90*a*) in addition to the outer circumferential portion of the second swash plate 95 located between the first swash plate 90 and the shoes 93B. This hinders the first swash plate 90 from sliding with respect to the second swash plate 95. Therefore, it is difficult to significantly reduce the relative rotation speed of the second swash plate 95 and the shoes 93B as compared to the relative rotation speed of the shoes 93A and the first swash plate 90. Therefore, the advantages (such as reduced mechanical loss) of providing the second swash plate 95 are not sufficiently obtained.

It has become a common practice to use carbon dioxide as refrigerant of the refrigeration circuit. When carbon dioxide refrigerant is used, the pressure in the refrigeration circuit becomes extremely high as compared to a case where chlorofluorocarbon refrigerant (for example, R134a) is used. Therefore, the reaction force of compression applied to the pistons 94 is increased in the swash plate compressor, which increases the pressure between the first swash plate 90 and the second swash plate 95, and the aforementioned problem has become a significant matter of concern.

Patent Document 1: Japanese Laid-Open Patent Publication No. 8-28447 (page 3, FIG. 1)

Patent Document 2: Japanese Laid-Open Patent Publication No. 8-338363 (page 4, FIG. 1)

DISCLOSURE OF THE INVENTION

Accordingly, it is an objective of the present invention to provide a swash plate compressor in which a first swash plate reliably slides with respect to a second swash plate.

To achieve the above objective, the present invention provides a swash plate compressor. A first swash plate is coupled to a drive shaft to be rotatable integrally with the drive shaft. The first swash plate supports a second swash plate. Pistons are coupled to the first swash plate and the second swash plate via first shoes, which abut against the first swash plate, and second shoes, which abut against the second swash plate and receive a reaction force of compression. Rotation of the drive shaft rotates the first swash plate, which causes the pistons to reciprocate and compress refrigerant gas. The compressor includes a thrust bearing and a radial bearing. The thrust bearing is arranged between the first shoes and the second shoes, specifically between the outer circumferential portion of the first swash plate and the outer circumferential portion of the second swash plate. The thrust bearing supports the second swash plate to be rotatable relative to the first swash plate. The radial bearing is arranged between the inner circumferential portion of the first swash plate and the inner circumferential portion of the second swash plate. The radial bearing supports the second swash plate to be rotatable relative to the first swash plate.

Therefore, the first swash plate easily slides with respect to the second swash plate, and the relative rotation speed of the second swash plate and the shoes is easily reduced significantly than the relative rotation speed of the shoes and the swash plate. Therefore, the advantages (such as reduced mechanical loss) of providing the second swash plate are sufficiently obtained.

The radial bearing refers to a bearing having a configuration that can receive the radial load applied to the second swash plate in a suitable manner, and the thrust bearing refers to a bearing having a configuration that can receive the thrust load applied to the second swash plate in a suitable manner. Therefore, the radial bearing may be configured to receive the thrust load in addition to the radial load, and the thrust bearing may be configured to receive the radial load in addition to the thrust load.

In a preferred embodiment, a support portion, which rotatably supports the second swash plate via the radial bearing, projects from the first swash plate. An accommodating groove, which accommodates part of the radial bearing, is formed in the first swash plate about the proximal portion of the support portion. Therefore, the bearing is arranged close to the proximal portion of the support portion. This reduces the projecting amount of the bearing, or the support portion, from the swash plate. Thus, the size of the swash plate is reduced.

In the preferred embodiment, the friction coefficient between the first swash plate and the second swash plate is set smaller than the friction coefficient between the second shoes and the second swash plate. Therefore, the second swash plate more reliably slides with respect to the first swash plate.

In the preferred embodiment, the plate thickness of the outer circumferential portion of the second swash plate is one third or more of the plate thickness of the outer circumferential portion of the first swash plate and is thinner than the plate thickness of the outer circumferential portion of the first swash plate.

To avoid enlargement of the pistons, that is, enlargement of the variable displacement swash plate compressor, a space between the first shoes and the second shoes is limited. In this limited space, when the plate thickness of the outer circumferential portion of the first swash plate is increased, the plate thickness of the outer circumferential portion of the second swash plate needs to be reduced. In contrast, when the plate thickness of the outer circumferential portion of the second swash plate is increased, the plate thickness of the outer circumferential portion of the first swash plate needs to be reduced. In terms of receiving the reaction force of compression, the plate thicknesses of the outer circumferential portions of the first and the second swash plates need to be as thick as possible to secure the strength. However, securing the plate thickness of the outer circumferential portion of the first swash plate to which power is transmitted from the drive shaft should take precedence to securing the plate thickness of the outer circumferential portion of the second swash plate that is only required to slide with respect to the first swash plate. In this respect, it is suitable to set the plate thickness of the outer circumferential portion of the second swash plate to be half or more of the plate thickness of the outer circumferential portion of the first swash plate and thinner than the plate thickness of the outer circumferential portion of the first swash plate.

In the preferred embodiment, the second swash plate has an annular shape, and the plate thickness of the inner circumferential portion of the second swash plate that is supported by the radial bearing is greater than the plate thickness of the outer circumferential portion of the second swash plate located between the first swash plate and the second shoes. Therefore, the thick inner circumferential portion permits the second swash plate to be stably supported with the bearing, and improves the sliding performance between the second swash plate and the first swash plate.

In the preferred embodiment, the plate thickness of the outer circumferential portion of the second swash plate is thinner than the plate thickness of the outer circumferential portion of the first swash plate. The plate thickness of the inner circumferential portion of the second swash plate is thicker than the plate thickness of the outer circumferential portion of the first swash plate.

Therefore, the thin outer circumferential portion of the second swash plate facilitates securing the plate thickness of the outer circumferential portion of the first swash plate that is required to have a greater strength than the second swash plate. The plate thickness of the inner circumferential portion of the second swash plate is thicker than the plate thickness of the outer circumferential portion of the first swash plate. Therefore, the radial bearing more stably supports the second swash plate.

In the preferred embodiment, the inner circumferential portion of the second swash plate is provided with a cylindrical first projection, which projects toward the first swash plate, and a cylindrical second projection, which projects opposite to the first swash plate, so that the plate thickness of the inner circumferential portion of the second swash plate is thicker than the plate thickness of the outer circumferential portion of the second swash plate. The outer diameter of the second projection is smaller than the outer diameter of the first projection.

When the displacement of the variable displacement swash plate compressor is maximum, for example, part of the second projection significantly approaches the piston located at the bottom dead center position. Therefore, it is effective to make the diameter of the second projection to be smaller than that of the first projection, thereby separating the second projection from the piston, in view of avoiding interference between the second swash plate and the pistons while increasing the plate thickness of the inner circumferential portion of the second swash plate.

In the preferred embodiment, the radial bearing is formed of a roller bearing, and rollers are used as rolling elements of the radial bearing. The roller bearing that uses the rollers as the rolling elements has superior load bearing properties as compared to, for example, a case where balls are used as the rolling elements. This reduces the size of the radial bearing, which reduces the size of the swash plate compressor.

In the preferred embodiment, the thrust bearing is formed of a roller bearing. A race is located between rolling elements of the thrust bearing and the first swash plate. The race is rotatable relative to the first swash plate.

In a case of a configuration in which, for example, the rolling elements of the thrust bearing roll directly on the first swash plate, a significant reaction force of compression is concentrated on part of the first swash plate (part of the first swash plate corresponding to the piston located in the vicinity of the top dead center position), which may cause partial wear and deterioration. However, in the present invention, since the race is provided between the rolling elements and the first swash plate, the reaction force of compression applied to the rolling elements is applied to the first swash plate with reduced contact pressure via the race. Therefore, the first swash plate is suppressed from being partially worn and deteriorated. Also, as for the race that rotates relative to the first swash plate, the section to which a significant reaction force of compression is applied via the rolling elements is sequentially changed. This prevents the race from being partially worn and deteriorated.

In the preferred embodiment, an engaging portion projects from the outer circumferential portion of the first swash plate toward the second swash plate. The abutment between the race and the engaging portion engages the race with the first swash plate at the radially outward edge.

For example, in a configuration in which the engaging portion is provided at the inner circumferential portion of the first swash plate and the race is engaged with the first swash plate at the radially inward edge, when lubricant (refrigerant oil) that is adhered to the first swash plate moves radially outward by centrifugal force, the engaging portion hinders the lubricant from entering between the first swash plate and the race. However, the present invention in which the race is engaged with the first swash plate at the radially outward edge prevents the engaging portion from hindering the lubricant from entering between the first swash plate and the race. Thus, the first swash plate reliably slides with respect to the race.

In the preferred embodiment, the engaging portion has an annular shape. Therefore, the engaging portion is stably engaged with the race. Thus, the race further reliably slides with respect to the first swash plate.

In the preferred embodiment, the inner circumferential portion of the second swash plate is provided with a cylindrical projection, which projects opposite to the first swash plate, so that the plate thickness of the inner circumferential portion of the second swash plate is thicker than the plate thickness of the outer circumferential portion of the second swash plate. An inclined surface (a chamfer) is provided at the outer circumferential corner of the distal end face of the projection. The inclined surface (the chamfer) reduces the weight of the second swash plate.

In the preferred embodiment, weight reduction holes are formed through the second swash plate extending in the direction of the plate thickness. The weight reduction holes reduce the weight of the second swash plate.

In the preferred embodiment, weight reduction recesses are formed in at least one of the front surface and the rear surface of the second swash plate. The weight reduction recesses reduce the weight of the second swash plate.

In the preferred embodiment, an oil introducing passage is provided in at least one of the first swash plate and the second swash plate for introducing oil between the first swash plate and the second swash plate from the outside. Therefore, the oil permits the second swash plate to more reliably slide with respect to the first swash plate.

In the preferred embodiment, the oil introducing passage includes a through hole formed in the first swash plate or the second swash plate.

In the preferred embodiment, the swash plate compressor is a variable displacement swash plate compressor in which the displacement is varied by changing the inclination angle of the first and second swash plates.

In the preferred embodiment, the gas is refrigerant gas used in a refrigeration circuit, and carbon dioxide is used as the refrigerant gas.

When carbon dioxide refrigerant is used, the pressure in the refrigeration circuit becomes extremely high as compared to a case where chlorofluorocarbon refrigerant (for example, R134a) is used. Therefore, the reaction force of compression applied to the pistons in the swash plate compressor is increased, which increases the pressure between the first swash plate and the second swash plate. In the above embodiment, it is particularly effective to provide the thrust bearing and the radial bearing between the first swash plate and the second swash plate so that the first swash plate easily slides with respect to the second swash plate.

DETAILED DESCRIPTION OF THE PREFERRED EMBODIMENTS

A variable displacement swash plate compressor according to first to seventh embodiments of the present invention will now be described. The compressor forms part of a refrigeration circuit of a vehicle air-conditioning system.

The first embodiment will be described with reference to FIGS. 1 and 2.

Figure 1:
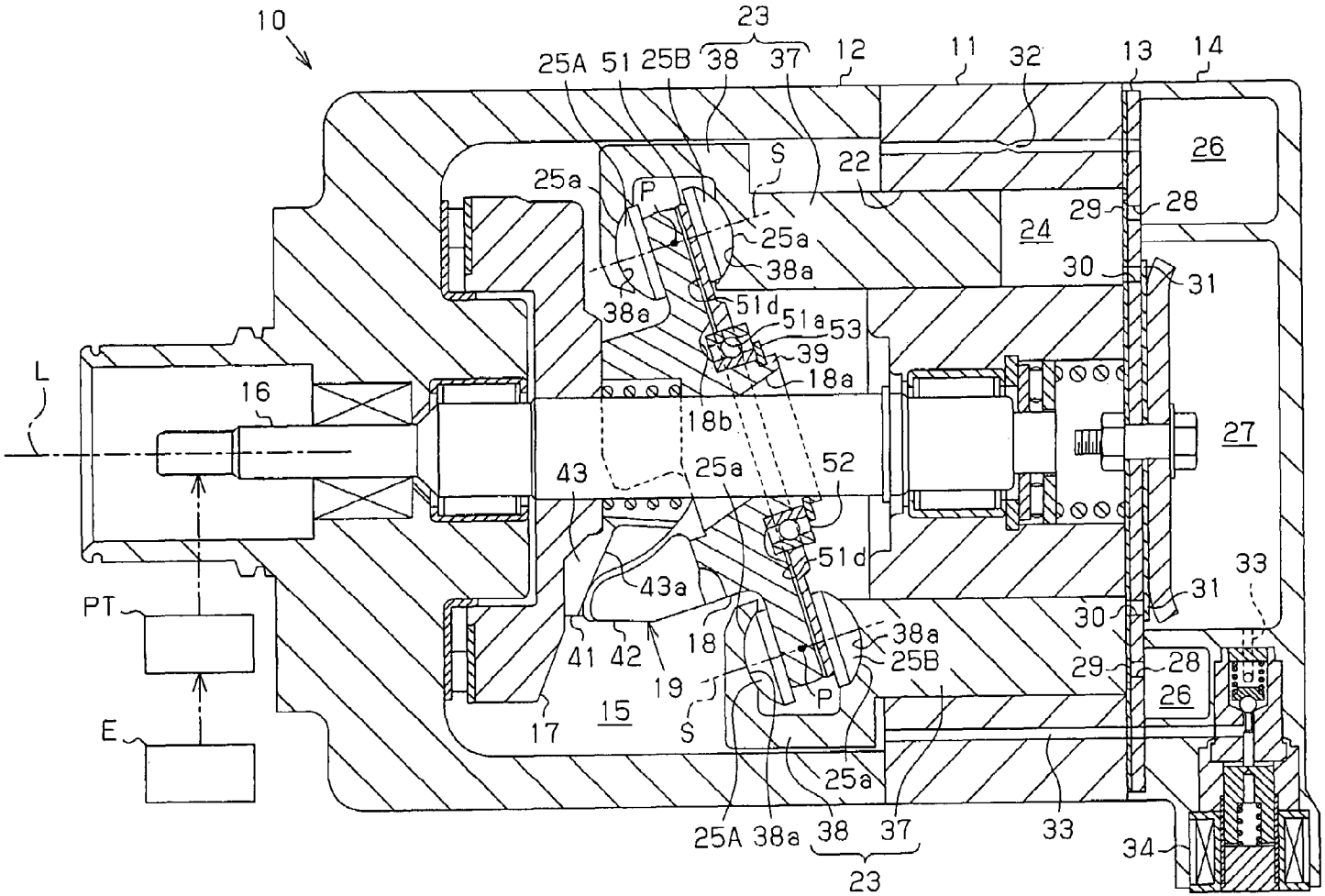
FIG. 1 is a longitudinal cross-sectional view illustrating a swash plate compressor according to a first embodiment of the present invention.

FIG. 1 is a longitudinal cross-sectional view of the variable displacement swash plate compressor (hereinafter, simply referred to as the compressor) 10. The left end of the compressor 10 in FIG. 1 is defined as the front of the compressor 10, and the right end is defined as the rear of the compressor 10.

As shown in FIG. 1, a housing of the compressor 10 includes a cylinder block 11, a front housing member 12 secured to the front end of the cylinder block 11, and a rear housing member 14 secured to the rear end of the cylinder block 11 with a valve plate assembly 13 in between.

In the housing of the compressor 10, the cylinder block 11 and the front housing member 12 define a crank chamber 15. The cylinder block 11 and the front housing member 12 define the crank chamber 15. A drive shaft 16 extends through the crank chamber 15 and is rotatable with respect to the cylinder block 11 and the front housing 12. The drive shaft 16 is coupled to a power source of the vehicle, which is an engine E in this embodiment, through a clutchless type power transmission mechanism PT, which constantly transmits power. Therefore, the drive shaft 16 is always rotated by the power supply from the engine E when the engine E is running.

A rotor 17 is coupled to the drive shaft 16 and is located in the crank chamber 15. The rotor 17 rotates integrally with the drive shaft 16. The crank chamber 15 accommodates a substantially disk-like first swash plate 18. The first swash plate 18 is formed of an iron based metal material (pure iron or an iron alloy). A through hole 18*a* is formed at the center of the first swash plate 18. The drive shaft 16 is inserted through the through hole 18*a* of the first swash plate 18. The first swash plate 18 is supported by the drive shaft 16 via the through hole 18*a* to be slidable and tiltable with respect to the drive shaft 16. A hinge mechanism 19 is located between the rotor 17 and the first swash plate 18.

The hinge mechanism 19 includes two rotor protrusions 41 (one of the protrusions 41 located toward the front of the sheet of FIG. 1 is not shown), which protrude from the rear surface of the rotor 17, and a swash plate protrusion 42, which protrudes from the front surface of the first swash plate 18 toward the rotor 17. The distal end of the swash plate protrusion 42 is inserted between the two rotor protrusions 41. Therefore, rotational force of the rotor 17 is transmitted to the first swash plate 18 via the rotor protrusions 41 and the swash plate protrusion 42.

A cam portion 43 is formed at the proximal end of the rotor protrusions 41. A cam surface 43*a* is formed on the rear end face of the cam portion 43 facing the first swash plate 18. The distal end of the swash plate protrusion 42 slidably abuts against the cam surface 43*a* of the cam portion 43. Therefore, the hinge mechanism 19 guides the inclination of the first swash plate 18 as the distal end of the swash plate protrusion 42 moves toward and apart from the drive shaft 16 along the cam surface 43*a* of the cam portion 43.

Cylinder bores 22 are formed in the cylinder block 11 about the axis L of the drive shaft 16 at equal angular intervals and extend in the front-rear direction (left-right direction on the sheet of FIG. 1). A single head piston 23 is accommodated in each cylinder bore 22 to be movable in the front-rear direction. The front and rear openings of each cylinder bore 22 are closed by the front end face of the valve plate assembly 13 and the associated piston 23. Each cylinder bore 22 defines a compression chamber 24. The volume of each compression chamber 24 changes according to the reciprocation of the corresponding piston 23.

Each piston 23 is formed by coupling, in the front-rear direction, a columnar head portion 37, which is inserted in the associated cylinder bore 22, and a neck 38 located in the crank chamber 15 outside the cylinder bore 22. The head portions 37 and the necks 38 are formed of an aluminum based metal material (pure aluminum or an aluminum alloy). A pair of shoe seats 38*a* are formed in each neck 38. Each neck 38 accommodates semispherical first and second shoes 25A, 25B. The first shoe 25A and the second shoe 25B are formed of iron based metal material. In this specification, "semisphere" refers not only to a half of a sphere, but also to a shape that includes part of a spherical surface.

The first shoe 25A and the second shoe 25B are each received by the associated shoe seat 38*a* via a semispherical surface 25*a*. The semispherical surface 25*a* of the first shoe 25A and the semispherical surface 25*a* of the second shoe 25B are located on the same spherical surface defined about a center of curvature point P of the semispherical surfaces 25*a*. Each piston 23 is coupled to the outer circumferential portion of the first swash plate 18 and a second swash plate 51 via the first shoe 25A and the second shoe 25B. Therefore, when the first swash plate 18 is rotated by the rotation of the drive shaft 16, the pistons 23 reciprocate in the front-rear direction.

An intake chamber 26 and a discharge chamber 27 are defined between the valve plate assembly 13 and the rear housing member 14 in the housing of the compressor 10. The valve plate assembly 13 includes intake ports 28 and intake valves 29 located between the compression chambers 24 and the intake chamber 26. The valve plate assembly 13 also includes discharge ports 30 and discharge valves 31 located between the compression chambers 24 and the discharge chamber 27.

As refrigerant of the refrigeration circuit, carbon dioxide is used. Refrigerant gas introduced into the intake chamber 26 from an external circuit, which is not shown, is drawn into each compression chamber 24 via the associated intake port 28 and the intake valve 29 as the corresponding piston 23 moves from the top dead center position to the bottom dead center position. The refrigerant gas that is drawn into the compression chamber 24 is compressed to a predetermined pressure as the piston 23 is moved from the bottom dead center position to the top dead center position, and is discharged to the discharge chamber 27 through the associated discharge port 30 and the discharge valve 31. The refrigerant gas in the discharge chamber 27 is then conducted to the external circuit.

A bleed passage 32, a supply passage 33, and a control valve 34 are provided in the housing of the compressor 10. The bleed passage 32 connects the crank chamber 15 to the intake chamber 26. The supply passage 33 connects the discharge chamber 27 to the crank chamber 15. The control valve 34, which is a conventional electromagnetic valve, is located in the supply passage 33.

The opening degree of the control valve 34 is adjusted by controlling power supply from the outside to control the balance between the flow rate of highly pressurized discharge gas supplied to the crank chamber 15 through the supply passage 33 and the flow rate of gas conducted out of the crank chamber 15 through the bleed passage 32. The pressure in the crank chamber 15 is thus determined. As the pressure in the crank chamber 15 varies, the difference between the pressure in the crank chamber 15 and the pressure in the compression chamber 24 is changed, which in turn varies the inclination angle of the first swash plate 18. Accordingly, the stroke of each piston 23, or the displacement of the compressor 10 is adjusted.

For example, when the opening degree of the control valve 34 is reduced, the pressure in the crank chamber 15 is reduced. Therefore, the inclination angle of the first swash plate 18 increases, thereby increasing the stroke of each piston 23. Thus, the displacement of the compressor 10 is increased. In contrast, when the opening degree of the control valve 34 increases, the pressure in the crank chamber 15 is increased. Therefore, the inclination angle of the first swash plate 18 is reduced, thereby reducing the stroke of each piston 23. Thus, the displacement of the compressor 10 is reduced.

Figure 2:
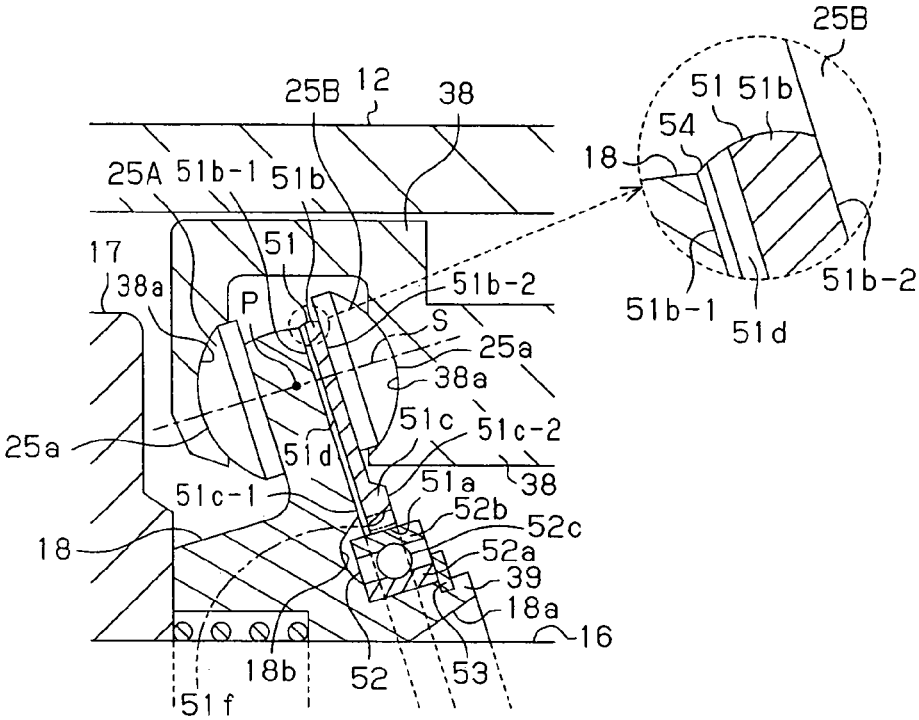
FIG. 2 is an enlarged partial view of FIG. 1.

As shown in FIG. 2, a substantially cylindrical support portion 39 projects at the center of the rear surface of the first swash plate 18 to surround the drive shaft 16. The annular second swash plate 51 is arranged outward of the support portion 39 of the first swash plate 18. A support hole 51*a* is formed at the center of the second swash plate 51. The support portion 39 is inserted in the support hole 51*a*. A bearing, which is a ball bearing 52 in this embodiment, is provided between the outer circumferential surface of the support portion 39 and the inner circumferential surface of the support hole 51*a* of the second swash plate 51. The ball bearing 52 is a radial bearing, and a radial load of the second swash plate 51 is supported by the first swash plate 18 (the support portion 39) via the ball bearing 52. The ball bearing 52 includes a substantially cylindrical inner race 52*a*, a substantially cylindrical outer race 52*b*, which is arranged outward of the inner race 52*a*, and rolling elements, which are balls 52*c* in this embodiment, arranged between the inner race 52*a* and the outer race 52*b*.

An accommodating groove 18*b* is formed in an annular section about the proximal portion of the support portion 39 on the rear surface of the first swash plate 18. The ball bearing 52 is fitted about the support portion 39 such that parts of the inner race 52*a* and the outer race 52*b* of the ball bearing 52 are located in the accommodating groove 18*b*. A snap ring 53 is engaged with the outer circumferential surface of the distal end of the support portion 39. The ball bearing 52 is prevented from falling off the support portion 39 by the abutment between the snap ring 53 and the inner race 52*a*. The outer race 52*b* of the ball bearing 52 is press fitted to the support hole 51*a* of the second swash plate 51. Therefore, the second swash plate 51 is rotatable integrally with the outer race 52*b* of the ball bearing 52, that is, the second swash plate 51 is rotatable relative to the support portion 39 (the first swash plate 18).

An outer circumferential portion 51*b* of the second swash plate 51 is arranged between the first swash plate 18 and the second shoes 25B toward the compression chamber 24 (that receive a reaction force of compression) to be slidable with respect to the first swash plate 18 and the shoes 25B. The plate thickness of an inner circumferential portion 51*c* of the second swash plate 51 that is directly supported by the ball bearing 52 is greater than the plate thickness of the outer circumferential portion 51*b* located between the first swash plate 18 and the second shoes 25B.

On the front surface of the second swash plate 51 that slides with respect to the first swash plate 18, a section 51*b*-1 of the outer circumferential portion 51*b* and a section 51*c*-1 of the inner circumferential portion 51*c* are flush with each other. Therefore, on the rear surface of the second swash plate 51, a section 51*c*-2 of the inner circumferential portion 51*c* is displaced in parallel rearward than a section 51*b*-2 of the outer circumferential portion 51*b* that slides with respect to the second shoes 25B so that the plate thickness of the inner circumferential portion 51*c* of the second swash plate 51 is greater than the plate thickness of the outer circumferential portion 51*b*. The section 51*b*-2 and the section 51*c*-2 are smoothly connected with an inclined surface to reduce concentration of stress at the connecting portion between the section 51*b*-2 and the section 51*c*-2.

As for the base material of the second swash plate 51, mild steel such as SPC (polishing material) and SPHC (pickled material) is used. A coating 54, which is a solid lubricant, is formed on the front surface of the second swash plate, that is, the section 51*b*-1 of the outer circumferential portion 51*b* and the section 51*c*-1 of the inner circumferential portion 51*c* (an enlarged view of FIG. 2 shows only the section 51*b*-1 with the thickness of the coating 54 being exaggerated). As for the solid lubricant, for example, molybdenum disulfide and fluorocarbon resin such as PTFE (polytetrafluoroethylene) are used.

Oil grooves 51*d* are formed in the front surface of the second swash plate 51 (the section 51*b*-1 and the section 51*c*-1) extending radially outward about the center of the annular second swash plate 51. The oil groove 51*d* functions as an oil introducing passage for introducing oil (refrigerant oil) in the crank chamber 15 to the sliding portion between the first swash plate 18 and the second swash plate 51.

The sliding portion between the first swash plate 18 and the second swash plate 51 has a lower friction coefficient than the sliding portion between the second shoes 25B and the second swash plate 51 because of the coating 54, which is the solid lubricant, and the introduction of oil via the oil grooves 51*d*.

When the first swash plate 18 is rotated, the first swash plate 18 slides relative to the second swash plate 51, which reduces the rotation speed of the second swash plate 51 as compared to the rotation speed of the first swash plate 18. Therefore, the relative rotation speed of the second swash plate 51 and the second shoes 25B (the relative rotation speed of the second swash plate 51 with respect to the second shoes 25B) is reduced as compared to the relative rotation speed of the second shoes 25B and the first swash plate 18 (the relative rotation speed of the first swash plate 18 with respect to the second shoes 25B). This suppresses the rotation of each second shoe 25B about the axis S (a line that passes through the center of curvature point P of the semispherical surface 25*a* and is perpendicular to a flat surface that slides with respect to the first swash plate 18) caused by the relative rotation of the second swash plate 51 and the second shoe 25B. Thus, mechanical loss and occurrence of problems caused by the rotation of the second shoes 25B are suppressed.

The first embodiment has the following advantages.

(1-1) The second swash plate 51 is supported by the first swash plate 18 via the ball bearing 52 to be rotatable relative to the first swash plate 18. Therefore, the first swash plate 18 easily slides with respect to the second swash plate 51, and the relative rotation speed of the second swash plate 51 and the second shoes 25B (the relative rotation speed of the second swash plate 51 with respect to the second shoes 25B) is easily reduced significantly than the relative rotation speed of the second shoes 25B and the first swash plate 18 (the relative rotation speed of the first swash plate 18 with respect to the second shoes 25B). Therefore, the advantages (such as reduced mechanical loss) of providing the second swash plate 51 are sufficiently obtained.

(1-2) The pistons 23 are single head pistons. Therefore, the second shoes 25B that receive a reaction force of compression are strongly pressed against the pistons 23 as compared to the first shoes 25A on the opposite side. Therefore, the sliding condition between the second shoes 25B and the pistons 23 is severe. In such a situation, providing the second swash plate 51 between the first swash plate 18 and the second shoes 25B that receive a reaction force of compression is particularly effective in obtaining the advantages (such as reduced mechanical loss) of providing the second swash plate 51.

(1-3) The first embodiment is applied to the compressor 10, which forms part of the refrigeration circuit, and carbon dioxide is used as the refrigerant of the refrigeration circuit. When carbon dioxide refrigerant is used, the pressure in the refrigeration circuit becomes extremely high as compared to a case where chlorofluorocarbon refrigerant (for example, R134a) is used. Therefore, the reaction force of compression applied to the pistons 23 in the compressor 10 is increased, which increases the pressure between the first swash plate 18 and the second swash plate 51. The first embodiment of the present invention is thus particularly effective in facilitating the first swash plate 18 to slide with respect to the second swash plate 51.

(1-4) The plate thickness of the inner circumferential portion 51*c* of the second swash plate 51 that is supported by the ball bearing 52 is greater than the plate thickness of the outer circumferential portion 51*b* located between the first swash plate 18 and the second shoes 25B. Therefore, the thick inner circumferential portion 51*c* permits the second swash plate 51 to be stably supported by the ball bearing 52, and improves the sliding performance between the second swash plate 51 and the first swash plate 18. In particular, in the first embodiment, the second swash plate 51 and the ball bearing 52 (the outer race 52*b*) are fixed through press fitting. Therefore, increasing the thickness of the inner circumferential portion 51*c* of the second swash plate 51 to which the ball bearing 52 is press fitted improves the durability of the inner circumferential portion 51*c* that directly receives stress caused by the press fitting.

Furthermore, since the outer circumferential portion 51*b* of the second swash plate 51 is thin, the second swash plate 51 can be provided between the first swash plate 18 and the second shoes 25B while suppressing the pistons 23 (the necks 38) from being enlarged.

The enlargement of the necks 38 of the pistons 23 leads to enlargement of the diameter of the compressor 10 (the cross-sectional diameter of the housing of the compressor 10). In particular, in the compressor 10 of the refrigeration circuit that uses carbon dioxide refrigerant, the diameters of the head portions 37 of the pistons 23 are likely to become small as compared to a compressor of a refrigeration circuit that uses, for example, chlorofluorocarbon refrigerant. Therefore, the enlargement of the neck portions 38 directly leads to enlargement of (the diameter of) the compressor 10.

That is, for example, when the outer circumferential portion 51*b* of the second swash plate 51 is thicker than that in FIG. 1, the thickness of the outer circumferential portion of the first swash plate 18 needs to be reduced, the size of the first shoes 25A and the second shoes 25B needs to be reduced (the area of the semispherical surfaces 25*a* needs to be reduced from the state shown in FIG. 1), or the radii of imaginary spheres on which the first shoes 25A and the second shoes 25B exist need to be increased. However, reducing the thickness of the outer circumferential portion of the first swash plate and reducing the size of the first shoes 25A and the second shoes 25B lead to decrease in the durability of the first swash plate 18 and the first and second shoes 25A, 25B, which is unfavorable. Therefore, the radii of the imaginary spheres on which the first shoes 25A and the second shoes 25B exist must be increased, which undesirably enlarges the pistons 23 (the neck portions 38).

(1-5) On the rear surface of the second swash plate 51, the section 51*c*-2 of the inner circumferential portion 51*c* is displaced in parallel rearward than the section 51*b*-2 of the outer circumferential portion 51*b* that slides with respect to the second shoes 25B so that the plate thickness of the inner circumferential portion 51*c* of the second swash plate 51 is greater than the plate thickness of the outer circumferential portion 51*b*. Therefore, as for the front surface of the second swash plate 51 that slides with respect to the first swash plate 18, the section 51*b*-1 of the outer circumferential portion 51*b* is made flush with the section 51*c*-1 of the inner circumferential portion 51*c*. This facilitates machining of the second swash plate 51 and secures a large sliding area between the second swash plate 51 and the first swash plate 18. Therefore, while providing the above mentioned advantage (1-4), the sliding friction between the first swash plate 18 and the second swash plate 51 is suppressed.

(1-6) The accommodating groove 18*b* is formed in the first swash plate 18 about the proximal portion of the support portion 39. Part of the ball bearing 52 is accommodated in the accommodating groove 18*b*. Therefore, the ball bearing 52 is arranged close to the proximal portion of the support portion 39. This reduces the projecting amount of the ball bearing 52 from the first swash plate 18, that is, rearward of the support portion 39. Thus, the size of the first swash plate 18 is reduced. This leads to reducing the size of the compressor 10.

(1-7) The friction coefficient between the first swash plate 18 and the second swash plate 51 is set smaller than the friction coefficient between the second shoes 25B and the second swash plate 51. Therefore, the second swash plate 51 more reliably slides with respect to the first swash plate 18.

(1-8) The second swash plate 51 is provided with the oil grooves 51*d* for introducing oil between the second swash plate 51 and the first swash plate 18 from the crank chamber 15. Therefore, the oil permits the second swash plate 51 to more reliably slide with respect to the first swash plate 18.

(1-9) The coating 54, which is a solid lubricant, is formed on the section 51*b*-1 of the outer circumferential portion 51*b* and the section 51*c*-1 of the inner circumferential portion 51*c*, which slide with respect to the first swash plate 18. The coating 54 is a thrust bearing, which is a sliding bearing. Therefore, the second swash plate 51 more reliably slides with respect to the first swash plate 18.

Next, a second embodiment will be described with reference to FIG. 3. In the second embodiment, only differences from the first embodiment are explained. Like or the same members are given the like or the same numbers and detailed explanations are omitted.

In the second embodiment, the oil grooves 51*d* are omitted from the first embodiment. Through holes 51*e* formed in the outer circumferential portion 51*b* of the second swash plate 51 extending in the direction of the plate thickness configure the oil introducing passage. The through holes 51*e* are provided to connect the sliding portion between the outer circumferential portion 51*b* (the section 51*b*-1) of the second swash plate 51 and the first swash plate 18 to the crank chamber 15. The through holes 51*e* (only one is shown in FIG. 3) are arranged at equal angular intervals about the center of the annular second swash plate 51.

Figure 3:
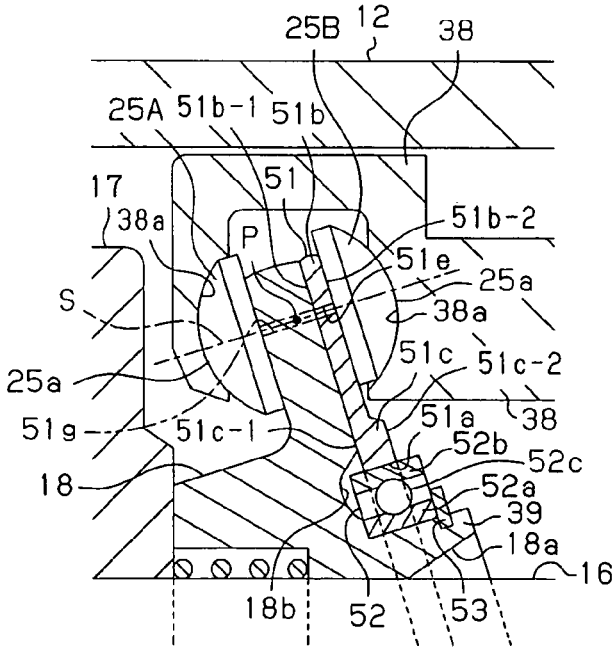
FIG. 3 is a partial cross-sectional view illustrating a second embodiment of the present invention.

FIG. 3 shows a state in which the opening of the through hole 51*e* to the crank chamber 15 is closed by one of the second shoes 25B. However, the opening is not always closed by the second shoe 25B, but is opened to the crank chamber 15 when the opening is displaced with respect to the second shoe 25B as the second shoe 25B rotates relative to the second swash plate 51.

Next, a third embodiment of the present invention will be described with reference to FIGS. 4 and 5. In the third embodiment, only differences from the second embodiment are explained. Like or the same members are given the like or the same numbers and detailed explanations are omitted.

As for the first shoes 25A and the second shoes 25B, each first shoe 25A located toward the hinge mechanism 19, or opposite to the associated compression chamber 24, slidably abuts against the front surface of an outer circumferential portion 18-1 of the first swash plate 18 via a sliding surface 25*b* opposite to the semispherical surface 25*a*. Also, each second shoe 25B located opposite to the hinge mechanism 19, or toward the associated compression chamber 24, and receives the reaction force of compression slidably abuts against the rear surface of an outer circumferential portion 51-2 of the second swash plate 51 via the sliding surface 25*b* opposite to the semispherical surface 25*a*. The center portion of the sliding surface 25*b* of the first shoe 25A bulges toward the first swash plate 18 (see FIG. 5. The bulge is exaggerated in FIG. 5). The sliding surface 25*b* of the second shoe 25B is flat.

A radial bearing 52A, which is a roller bearing, is located between the support portion 39, which forms the inner circumferential portion of the first swash plate 18, and an inner circumferential portion 51-1 of the second swash plate 51, and more specifically, between the outer circumferential surface of the support portion 39 and the inner circumferential surface of the support hole 51*a* of the second swash plate 51. The radial bearing 52A includes an outer race 52*e* attached to the inner circumferential surface of the support hole 51*a* of the second swash plate 51, an inner race 52*f* attached to the outer circumferential surface of the support portion 39 of the first swash plate 18, and rolling elements, which are rollers 52*g* in the third embodiment. The rollers 52*g* are located between the outer race 52*e* and the inner race 52*f*.

A thrust bearing 58, which is a roller bearing, is located between the first shoes 25A and the second shoes 25B and between the outer circumferential portion 18-1 of the first swash plate 18 and the outer circumferential portion 51-2 of the second swash plate 51. The thrust bearing 58 has rolling elements, which are rollers 58*a* in the third embodiment, and the rollers 58*a* are rotatably held by a retainer 58*b*. The thrust bearing 58 has an annular race 55 located between the rollers 58*a* and the first swash plate 18. The race 55 is formed by carburizing and heat treating base material formed of mild steel such as SPC. The corners at both ends of each roller 58*a* are chamfered to prevent the second swash plate 51 and the race 55 from being damaged by the rollers 58*a* abutting against the second swash plate 51 and the race 55.

An annular engaging portion 18*e* is provided on the rear surface of the first swash plate 18 at the outermost circumference of the outer circumferential portion 18-1 and projects toward the second swash plate 51. The race 55 is located inward of the engaging portion 18*e* and is engaged with the first swash plate 18 at the radially outward edge of the race 55 by the abutment between the outer circumferential edge of the race 55 and the engaging portion 18*e*. The race 55 is guided by the engaging portion 18*e* to rotate relative to the first swash plate 18.

The second swash plate 51 is supported by the first swash plate 18 via the radial bearing 52A and the thrust bearing 58 such that the second swash plate 51 rotates relative to and tilts integrally with the first swash plate 18. Therefore, when the first swash plate 18 is rotated, the radial bearing 52A and the thrust bearing 58 cause rolling motion between the first swash plate 18 and the second swash plate 51. Therefore, the mechanical loss caused by sliding motion between the first swash plate 18 and the second swash plate 51 is converted to the mechanical loss caused by the rolling motion. This significantly suppresses the mechanical loss in the compressor.

The plate thickness Y1 of the inner circumferential portion 51-1 of the second swash plate 51 that is supported by the radial bearing 52A is greater than the plate thickness Y2 of the outer circumferential portion 51-2 of the second swash plate 51 that is supported by the thrust bearing 58. More specifically, the plate thickness Y2 of the outer circumferential portion 51-2 of the second swash plate 51 is one third of the plate thickness X of the outer circumferential portion 18-1 of the first swash plate 18 and thinner than the plate thickness X of the outer circumferential portion 18-1 of the first swash plate 18. Also, the plate thickness Y1 of the inner circumferential portion 51-1 of the second swash plate 51 is thicker than the plate thickness X of the outer circumferential portion 18-1 of the first swash plate 18.

The plate thickness of the inner circumferential portion 51-1 of the second swash plate 51 is designed to be greater than that of the outer circumferential portion 51-2 of the second swash plate 51 (Y1>Y2) by providing a cylindrical first projection 56, which projects toward the first swash plate 18, and a cylindrical second projection 57, which projects opposite to the first swash plate 18. The first projection 56 and the second projection 57 are arranged coaxial with the support hole 51*a*, and the inner circumferential surfaces of the first projection 56 and the second projection 57 form part of the inner circumferential surface of the support hole 51*a*. The outer diameter Z2 of the second projection 57 is smaller than the outer diameter Z1 of the first projection 56. Also, an outer circumferential corner 57*a* of the distal end face of the second projection 57 is entirely provided with an inclined surface (a chamfer) to form a tapered face.

The support portion 39 is decentered with respect to the axis M1 of the first swash plate 18 toward the piston 23A located at the top dead center position. Therefore, the second swash plate 51, the radial bearing 52A, and the thrust bearing 58 (and the race 55) are decentered from the first swash plate 18 toward the piston 23A located at the top dead center position. Thus, the axis M2 of the second swash plate 51, the radial bearing 52A, and the thrust bearing 58 is slightly displaced in parallel from the axis M1 of the first swash plate 18 toward the center point P of the first shoe 25A and the second shoe 25B corresponding to the piston 23A located at the top dead center position (for example, 0.05 to 5 mm).

Part of the outer circumferential edge of the first swash plate 18 corresponding to the piston 23A located at the top dead center position and circumferentially adjacent parts thereof are provided with an inclined surface (a chamfer) on a salient corner 18*c* opposite to the second swash plate 51. The inclined surface (the chamfer) on the salient corner 18*c* is the largest at the part corresponding to the piston 23A located at the top dead center position, and gradually becomes smaller along the circumferential direction. The inclined surface (the chamfer) on the salient corner 18*c* is provided within a range of quarter to half the circumference of the first swash plate 18 with the part corresponding to the piston 23A located at the top dead center position arranged in the middle.

Part of the outer circumferential edge of the first swash plate 18 corresponding to the piston 23B located at the bottom dead center position and circumferentially adjacent parts thereof are provided with an inclined surface (a chamfer) on a salient corner 18*d* toward the second swash plate 51. The inclined surface (the chamfer) is the largest at the part corresponding to the piston 23B located at the bottom dead center position, and gradually becomes smaller along the circumferential direction. The inclined surface (the chamfer) of the salient corner 18*d* is provided within a range of quarter to half the circumference of the first swash plate 18 with the part corresponding to the piston 23B located at the bottom dead center position arranged in the middle. The inclined surface (the chamfer) on the salient corner 18*d* is substantially the same size as the inclined surface (the chamfer) on the salient corner 18*c* taking into consideration of the balance of the weight around the axis M1 of the first swash plate 18.

The third embodiment has the following advantages.

(3-1) The thrust bearing 58, which supports the second swash plate 51 to be rotatable relative to the first swash plate 18, is arranged between the first shoes 25A and the second shoes 25B and between the outer circumferential portion 18-1 of the first swash plate 18 and the outer circumferential portion 51-2 of the second swash plate 51. The radial bearing 52A, which supports the second swash plate 51 to be rotatable relative to the first swash plate 18, is arranged between the inner circumferential portion (the support portion 39) of the first swash plate 18 and the inner circumferential portion 51-1 of the second swash plate 51.

Therefore, the thrust bearing 58 and the radial bearing 52A effectively reduce the rotational resistance caused between the outer circumferential portion 18-1 of the first swash plate 18 and the outer circumferential portion 51-2 of the second swash plate 51, and between the inner circumferential portion (the support portion 39) of the first swash plate 18 and the inner circumferential portion 51-1 of the second swash plate 51. Therefore, even in the compressor 10 used for the refrigeration circuit that uses carbon dioxide as refrigerant, the sliding motion between the first swash plate 18 and the second swash plate 51 is converted to the mechanical loss caused by the rolling motion. As a result, problems such as the mechanical loss and the seizure are effectively suppressed.

(3-2) The plate thickness Y2 of the outer circumferential portion 51-2 of the second swash plate 51 is one third of the plate thickness X of the outer circumferential portion 18-1 of the first swash plate 18 and thinner than the plate thickness X of the outer circumferential portion 18-1. To avoid enlargement of the pistons 23, that is, enlargement of the compressor, a space between the first shoes 25A and the second shoes 25B is limited. In this limited space, when the plate thickness X of the outer circumferential portion 18-1 of the first swash plate 18 is increased, the plate thickness Y2 of the outer circumferential portion 51-2 of the second swash plate 51 needs to be reduced. In contrast, when the plate thickness Y2 of the outer circumferential portion 51-2 of the second swash plate 51 is increased, the plate thickness X of the outer circumferential portion 18-1 of the first swash plate 18 needs to be reduced.

In terms of receiving the reaction force of compression, the plate thicknesses X, Y2 of the outer circumferential portions 18-1, 51-2 of the first swash plate 18 and the second swash plate 51 need to be as thick as possible to secure the strength. However, securing the plate thickness X of the outer circumferential portion 18-1 of the first swash plate 18 to which power is transmitted from the drive shaft 16 should take precedence to securing the plate thickness Y2 of the outer circumferential portion 51-2 of the second swash plate 51 that is only required to slide with respect to the first swash plate 18. In this respect, it is suitable to set the plate thickness Y2 of the outer circumferential portion 51-2 of the second swash plate 51 to be one third of the plate thickness X of the outer circumferential portion 18-1 of the first swash plate 18 and thinner than the plate thickness X of the outer circumferential portion 18-1.

The inventor of the present invention performed 100 hours of test operation on the following configuration under a high load (100% displacement) with a high discharge pressure. The first swash plate 18 was made of cast iron, the second swash plate 51 was made of bearing steel, and the plate thickness Y2 of the outer circumferential portion 51-2 of the second swash plate 51 was one third of the plate thickness X of the outer circumferential portion 18-1 of the first swash plate and is thinner than the plate thickness X of the outer circumferential portion 18-1. The plate thickness X of the outer circumferential portion 18-1 was within a range of 5 to 6 mm. According to the test operation, problems (such as deformation of the second swash plate 51) did not occur and the configuration was found to be fit for the practical use.

(3-3) In the second swash plate 51, the plate thickness Y1 of the inner circumferential portion 51-1 is greater than the plate thickness Y2 of the outer circumferential portion 51-2. The thick inner circumferential portion 51-1 permits the second swash plate 51 to be stably supported by the radial bearing 52A, and improves the sliding performance between the first swash plate 18 and the second swash plate 51. Furthermore, since the outer circumferential portion 51-2 of the second swash plate 51 is relatively thinner than the inner circumferential portion 51-1, the plate thickness of the outer circumferential portion 18-1 of the first swash plate 18 that is required to have a greater strength than the second swash plate 51 is easily secured.

(3-4) The plate thickness Y2 of the outer circumferential portion 51-2 of the second swash plate 51 is thinner than the plate thickness X of the outer circumferential portion 18-1 of the first swash plate 18. Therefore, the thin outer circumferential portion 51-2 of the second swash plate 51 facilitates securing the plate thickness of the outer circumferential portion 18-1 of the first swash plate 18 that is required to have a greater strength than the second swash plate 51. The plate thickness Y1 of the inner circumferential portion 51-1 of the second swash plate 51 is greater than the plate thickness X of the outer circumferential portion 18-1 of the first swash plate 18. Therefore, the radial bearing 52A more stably supports the second swash plate 51.

(3-5) As for the first projection 56 and the second projection 57, which form the inner circumferential portion 51-1 of the second swash plate 51, the outer diameter Z2 of the second projection 57 is less than the outer diameter Z1 of the first projection 56. When the displacement of the compressor 10 is maximum (state shown in FIG. 1), for example, part of the second projection 57 significantly approaches the piston 23B located at the bottom dead center position. Therefore, it is effective to make the diameter of the second projection 57 to be smaller than that of the first projection 56, thereby separating the second projection 57 from the piston 23, in view of avoiding interference between the second swash plate 51 and the pistons 23 while increasing the plate thickness Y1 of the inner circumferential portion 51-1 of the second swash plate 51.

(3-6) As for the second projection 57, which forms the inner circumferential portion 51-1 of the second swash plate 51, the outer circumferential corner 57*a* of the distal end face is provided with the inclined surface. When the displacement of the compressor is maximum, for example, part of the outer circumferential corner 57*a* of the distal end face of the second projection 57 significantly approaches the piston 23B located at the bottom dead center position. Therefore, it is effective to provide the inclined surface on the outer circumferential corner 57*a* of the distal end face of the second projection 57 in view of avoiding interference between the second swash plate 51 and the pistons 23 while increasing the plate thickness Y1 of the inner circumferential portion 51-1 of the second swash plate 51.

(3-7) Part of the outer circumferential edge of the first swash plate 18 corresponding to the piston 23A located at the top dead center position is provided with the inclined surface on the salient corner 18*c* opposite to the second swash plate 51. Therefore, the first swash plate 18 and the second swash plate 51 can be enlarged while suppressing reduction in the durability and enlargement of the pistons 23. Therefore, the second swash plate 51 reliably slides with respect to the second shoes 25B, and the durability of the second swash plate 51 and the second shoes 25B is improved while suppressing reduction in the durability and enlargement of the pistons 23.

That is, at the outer circumferential edge of the first swash plate 18 that corresponds to the piston 23A located at the top dead center position, the salient corner 18*c* (that has not been provided with the inclined surface) opposite to the second swash plate 51 significantly projects in the radial direction of the drive shaft 16 when the first swash plate 18 tilts with respect to the drive shaft 16. When the salient corner 18*c* of the first swash plate 18 opposite to the second swash plate 51 significantly projects in the radial direction, the thickness of the necks 38 of the pistons 23 need to be reduced corresponding to the projecting portion, or the necks 38 need to be enlarged in the radial direction to avoid interference with the projecting portion. However, reducing the thickness of the necks 38 leads to reduction in the durability of the pistons 23, and enlargement of the necks 38 leads to enlargement of the compressor.

To solve such problems, the radius of the first swash plate 18 may be reduced to avoid interference between the salient corner 18*c* and the pistons 23. However, when the radius of the first swash plate 18 is reduced, the radius of the second swash plate 51, which needs to be supported by the first swash plate 18, must also be reduced. Therefore, in particular, the contact area between the second swash plate 51 and the second shoe 25B of the piston 23 located in the vicinity of the top dead center position (in the compression stroke) that receives a significant reaction force of compression is reduced, which reduces the durability of the second swash plate 51 and the second shoes 25B.

(3-8) As the rolling elements of the radial bearing 52A, the rollers 52*g* are used. The roller bearing that uses the rollers 52*g* as the rolling elements has superior load bearing properties as compared to, for example, a case where balls are used as the rolling elements. This reduces the size of the radial bearing 52A, which reduces the size of the compressor 10.

(3-9) The race 55 is located between the rollers 58*a* of the thrust bearing 58 and the first swash plate 18. The race 55 is rotatable relative to the first swash plate 18.

In a case of a configuration in which, for example, the rollers 58*a* of the thrust bearing 58 roll directly on the first swash plate 18, a significant reaction force of compression is concentrated on part of the first swash plate 18 (part of the first swash plate 18 corresponding to the piston 23 located in the vicinity of the top dead center position, which may cause partial wear and deterioration. However, in the second embodiment, since the race 55 is provided between the rollers 58*a* and the first swash plate 18, the reaction force of compression applied to the rollers 58*a* is applied to the first swash plate 18 with reduced contact pressure via the race 55. Therefore, the first swash plate 18 is suppressed from being partially worn and deteriorated. Also, as for the race 55 that rotates relative to the first swash plate 18, the section to which a significant reaction force of compression is applied via the rollers 58*a* is sequentially changed. This prevents the race 55 from being partially worn and deteriorated.

(3-10) The engaging portion 18*e* is provided on the outer circumferential portion 18-1 of the first swash plate 18 and extends toward the second swash plate 51. The race 55 is engaged with the first swash plate 18 by abutting against the engaging portion 18*e* at the radially outward edge of the race 55.

For example, in a configuration in which the engaging portion is provided at the inner circumferential portion of the first swash plate 18 and the race 55 is engaged with the first swash plate 18 at the radially inward edge, when lubricant (refrigerant oil) that is adhered to the first swash plate 18 moves radially outward by centrifugal force, the engaging portion hinders the lubricant from entering between the first swash plate 18 and the race 55. However, the third embodiment in which the race 55 is engaged with the first swash plate 18 at the radially outward edge prevents the engaging portion 18*e* from hindering the lubricant from entering between the first swash plate 18 and the race 55. Thus, the first swash plate 18 reliably slides with respect to the race 55.

(3-11) The engaging portion 18*e* has an annular shape. Therefore, the engaging portion 18*e* is stably engaged with the race 55. Thus, the race 55 further reliably slides with respect to the first swash plate 18.

(3-12) The second swash plate 51 is decentered from the first swash plate 18 toward the piston 23 located at the top dead center position. That is, the second swash plate 51 is displaced toward the second shoe 25B of the piston 23 located in the vicinity of the top dead center position. Therefore, the contact area between the second shoe 25B of the piston 23 located in the vicinity of the top dead center position (in the compression stroke) and the second swash plate 51 is increased without increasing the diameter of the first swash plate 18 and the second swash plate 51. Therefore, the second swash plate 51 reliably slides with respect to the second shoes 25B, and the durability of the second swash plate 51 and the second shoes 25B is improved while suppressing reduction in the durability and enlargement of the pistons 23.

As described above, when the second swash plate 51 is decentered from the first swash plate 18, at the outer circumferential edge of the first swash plate 18 that corresponds to the piston 23A located at the bottom dead center position, the salient corner 18*d* (that has not been provided with the inclined surface) toward the second swash plate 51 significantly projects from the second swash plate 51 in the radial direction of the drive shaft 16 when the first swash plate 18 tilts with respect to the drive shaft 16. Therefore, in the third embodiment, part of the outer circumferential edge of the first swash plate 18 corresponding to the piston 23B located at the bottom dead center position is provided with the inclined surface on the salient corner 18*d* toward the second swash plate 51. This permits the diameter of the first swash plate 18 and the second swash plate 51 to be increased while suppressing reduction in the durability and enlargement of the pistons 23, which improves the durability of the second swash plate 51 and the second shoes 25B.

(3-13) The inertial force (centrifugal force) caused by the rotation of the first swash plate 18 serves to decrease the inclination angle of the first swash plate 18. The inertial force of the reciprocation of the pistons 23 also affects the inclination angle of the first swash plate. That is, the inertial force of the reciprocation of the pistons 23 influences the speed of controlling the displacement (high-speed controllability).

When the first swash plate 18 is rotated, the first swash plate 18 slides relative to the second swash plate 51, which reduces the rotation speed of the second swash plate 51 as compared to the rotation speed of the first swash plate 18. Since the thrust bearing 58 is arranged between the first swash plate 18 and the second swash plate 51, the relative rotational speed of the second swash plate 51 with respect to the second shoes 25B is significantly smaller than the relative rotational speed of the first swash plate 18 with respect to the second shoes 25B. That is, the second swash plate 51 wobbles in the direction of axis L of the drive shaft 16 while rotating more slowly than the first swash plate 18 or without rotating at all. The inertial force caused by wobbling of the second swash plate 51, which performs such a wobbling motion (a motion that reciprocates the pistons 23), influences the high-speed controllability like the inertial force of the reciprocation of the pistons 23.

Reducing the weight of the second swash plate reduces the inertial force caused by wobbling of the second swash plate 51, which reduces the influence of the inertial force caused by the wobbling motion of the second swash plate 51 on the high-speed controllability. That is, reducing the weight of the second swash plate 51 improves the high-speed controllability.

The outer circumferential corner 57*a* of the second projection 57 is provided with the inclined surface (the chamfer) to form a tapered face. Such a chamfered structure reduces the weight of the second swash plate 51.

Next, a fourth embodiment of the present invention will be described with reference to FIG. 6. In the fourth embodiment, only differences from the third embodiment are explained. Like or the same members are given the like or the same numbers and detailed explanations are omitted.

In the fourth embodiment, the support portion 39 is not decentered from the axis M1 of the first swash plate 18. That is, the second swash plate 51, the radial bearing 52A, and the thrust bearing 58 (including the race 55) are not decentered from the first swash plate 18. In this case, as for part of the outer circumferential edge of the first swash plate 18 that corresponds to the piston 23B located at the bottom dead center position, the salient corner 18*d* need not be provided with an inclined surface (a chamfer) as shown in FIG. 6 because the salient corner 18*d* toward the second swash plate 51 does not significantly project in the radial direction from the second swash plate 51.

Furthermore, in the fourth embodiment, the PCD of the thrust bearing 58 is greater than the diameter of an imaginary cylinder defined about the axes M1, M2 of the first swash plate 18 and the second swash plate 51 and passes through the center points P of the first shoe 25A and the second shoe 25B. In this manner, the thrust bearing 58 (the rollers 58*a*) receives the reaction force of compression transmitted through the second swash plate 51 in a suitable manner, which improves the durability. The "PCD" of the thrust bearing 58 refers to the diameter of an imaginary cylinder having the axis at the center of the thrust bearing 58 (at the axes M1, M2 of the first swash plate 18 and the second swash plate 51) and passes through the mid point of the rotating axis of the rollers 58*a*.

Figure 7:
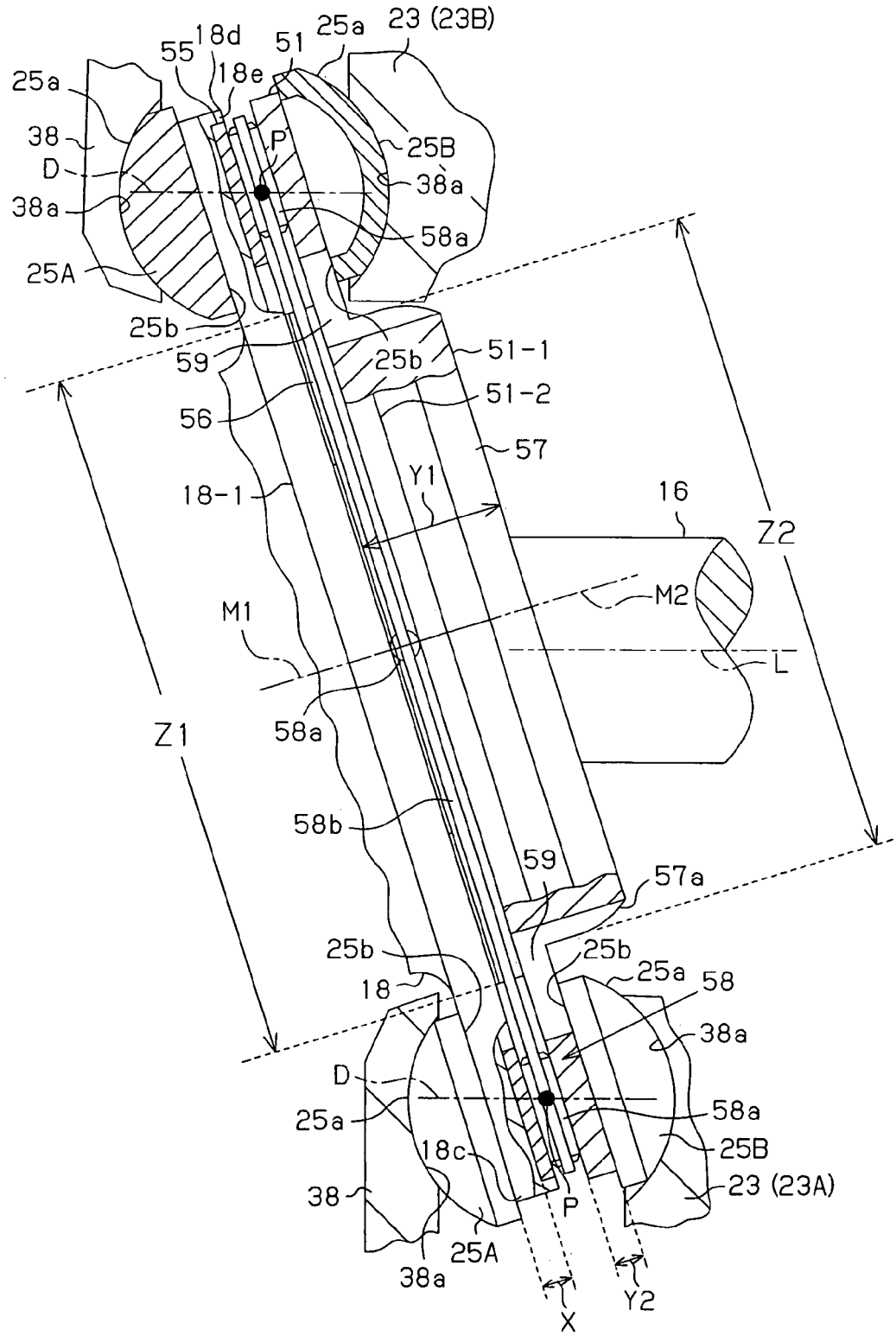
FIG. 7 is an enlarged partial view illustrating a swash plate configuration according to a fifth embodiment of the present invention.
Figure 8:
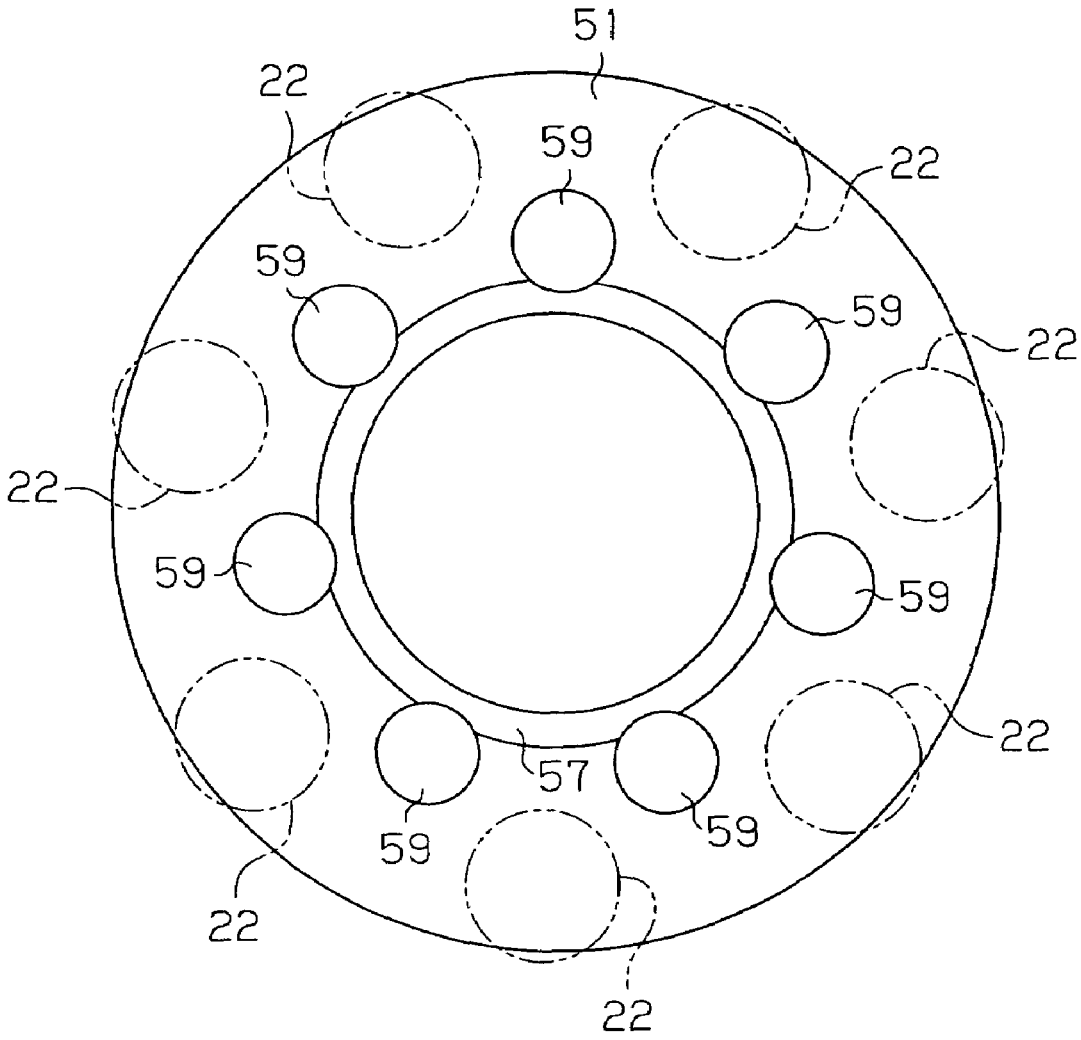
FIG. 8 is a rear view of the second swash plate shown in FIG. 7.

Next, a fifth embodiment of the present invention will be described with reference to FIGS. 7 and 8. In the fifth embodiment, only differences from the fourth embodiment are explained. Like or the same members are given the like or the same numbers and detailed explanations are omitted.

Weight reduction holes 59 are formed in the second swash plate 51 extending in the direction of the plate thickness. The weight reduction holes 59 are provided at equal angular intervals about the center of the annular second swash plate 51. The weight reduction holes 59 are provided inward of the section at which the rollers 58*a* of the thrust bearing 58 are arranged annularly. Therefore, the weight reduction holes 59 do not interfere with the rollers 58*a*.

The weight reduction holes 59 contribute to reducing the weight of the second swash plate 51. The configuration in which the weight reduction holes 59 are provided in the second swash plate 51 provides the advantage that is the same as the advantage (3-13) of the third embodiment.

Figure 9:
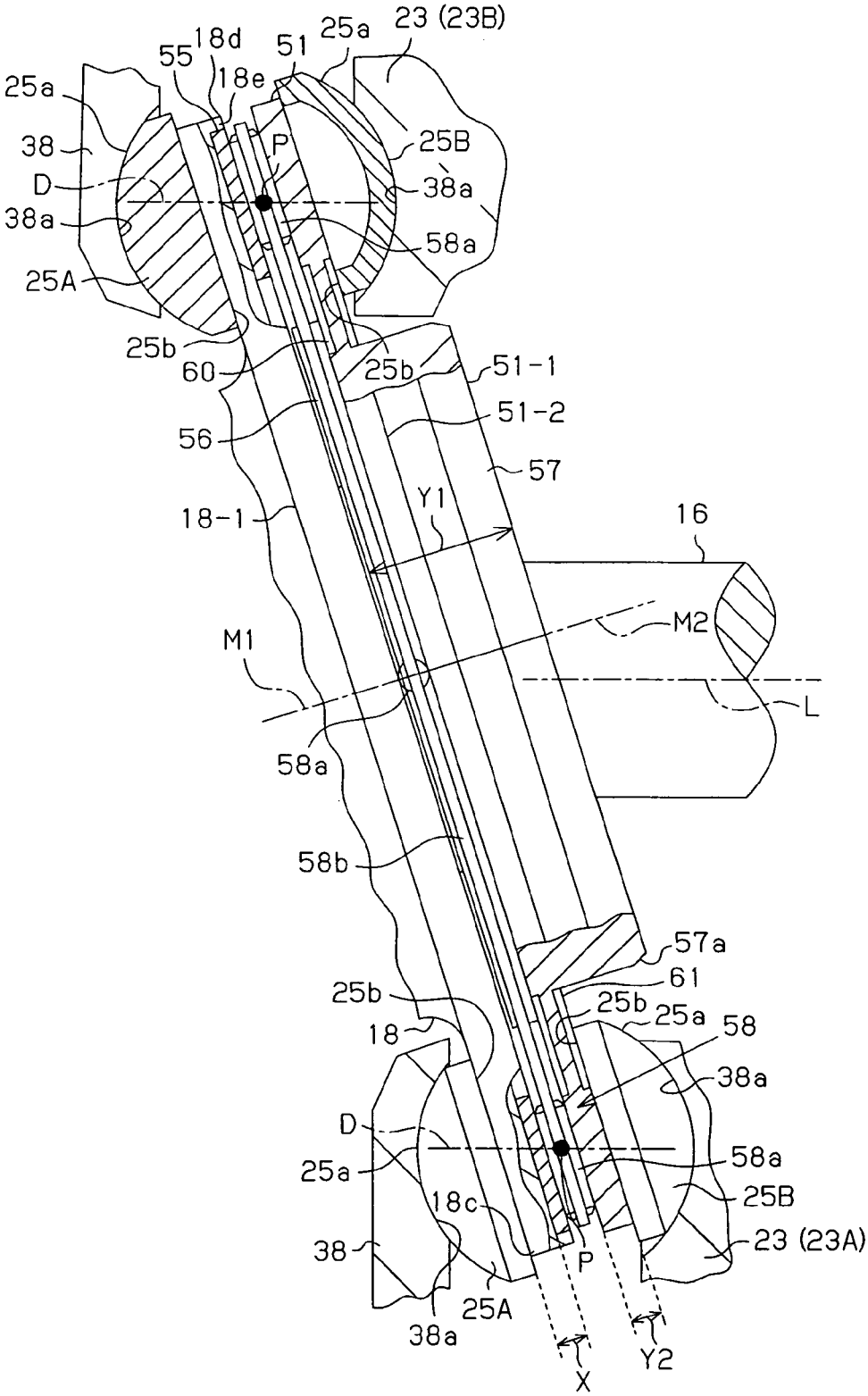
FIG. 9 is an enlarged partial view illustrating a swash plate configuration according to a sixth embodiment of the present invention.

Next, a sixth embodiment of the present invention will be described with reference to FIG. 9. In the sixth embodiment, only differences from the fourth embodiment are explained. Like or the same members are given the like or the same numbers and detailed explanations are omitted.

An annular weight reduction recess 60 is formed on the front surface of the second swash plate 51 about the inner circumferential portion 51-1, and an annular weight reduction recess 61 is formed on the rear surface of the second swash plate 51 about the inner circumferential portion 51-1. The weight reduction recesses 60, 61 are provided inward of the section at which the rollers 58*a* of the thrust bearing 58 are arranged annularly. Therefore, the weight reduction recess 60 does not interfere with the rollers 58*a*.

The weight reduction recesses 60, 61 contribute to reducing the weight of the second swash plate 51. The configuration in which the weight reduction recesses 60, 61 are provided in the second swash plate 51 provides the advantage that is the same as the advantage (3-13) of the third embodiment.

Figure 10:
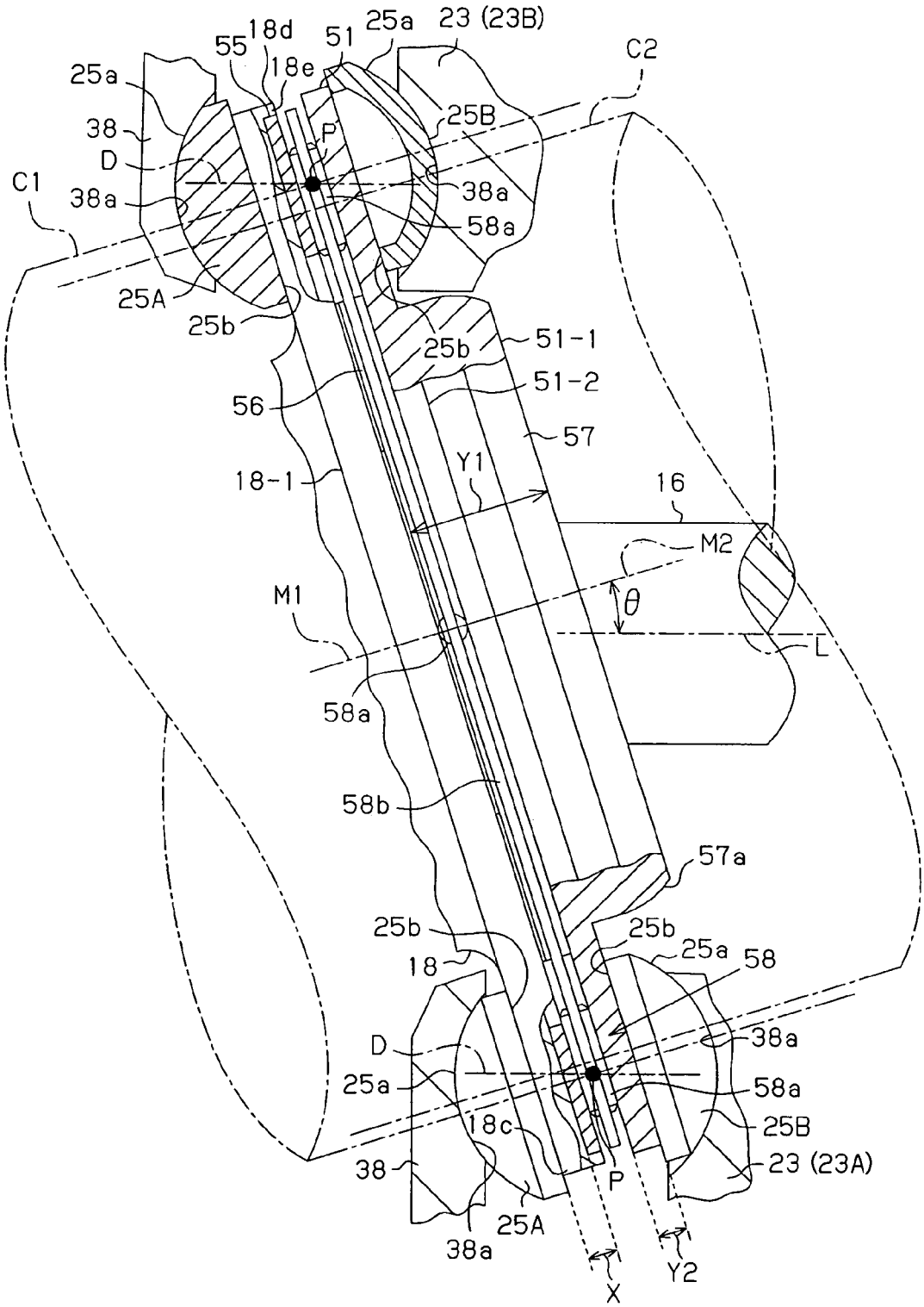
FIG. 10 is an enlarged partial view illustrating a swash plate configuration according to a seventh embodiment of the present invention.
Figure 11:
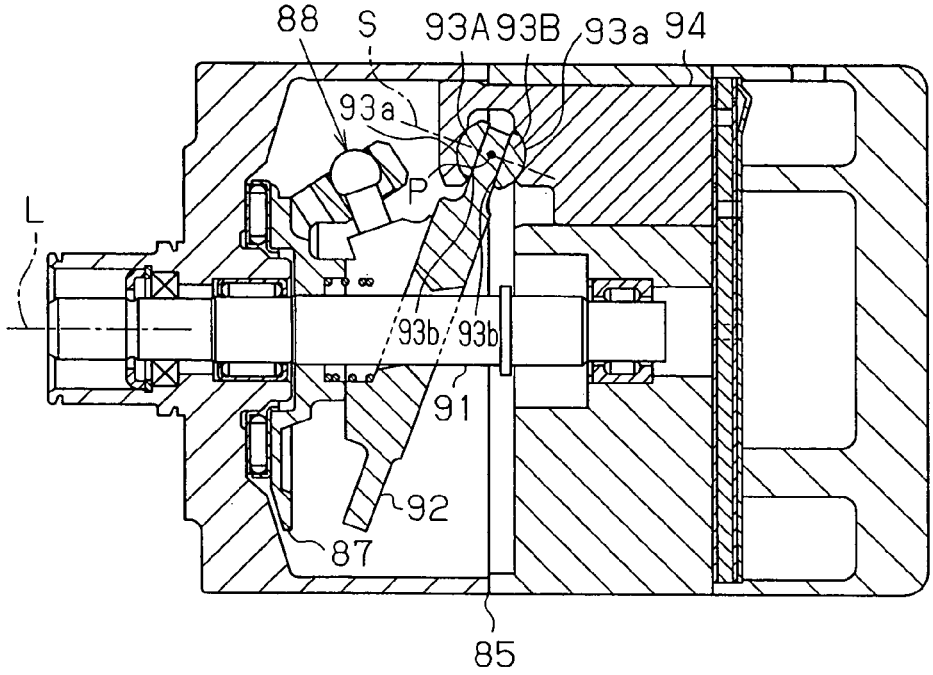
FIG. 11 is a longitudinal cross-sectional view illustrating a prior art variable displacement swash plate compressor.
Figure 12:
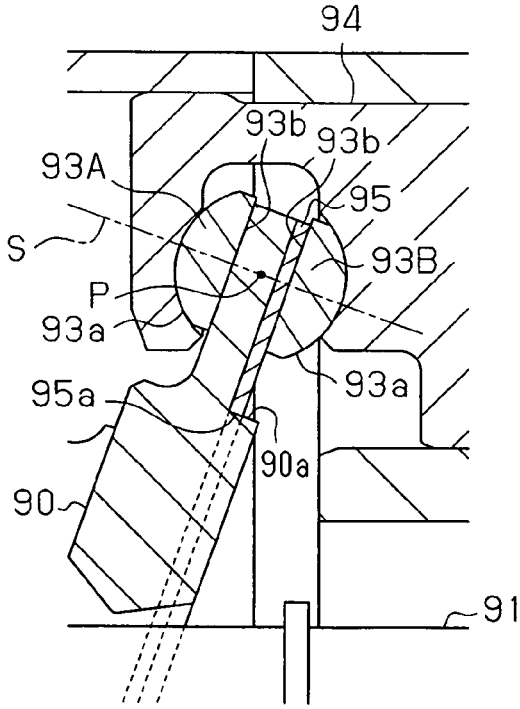
FIG. 12 is a partial cross-sectional view illustrating a prior art technique.

Next, a seventh embodiment of the present invention will be described with reference to FIG. 10. In the seventh embodiment, only differences from the fourth embodiment are explained. Like or the same members are given the like or the same numbers and detailed explanations are omitted.

In the seventh embodiment, the PCD of the thrust bearing 58 is smaller than the diameter of an imaginary cylinder C1 defined about the axes M1, M2 of the first swash plate 18 and the second swash plate 51 and passes through the center points P of the first shoe 25A and the second shoe 25B. In this manner, the thrust bearing 58 (the rollers 58*a*) receives the reaction force of compression transmitted through the second swash plate 51 in a suitable manner, which improves the durability. The "PCD" of the thrust bearing 58 refers to the diameter of an imaginary cylinder C2 having the axis at the center of the thrust bearing 58 (at the axes M1, M2 of the first swash plate 18 and the second swash plate 51) and passes through the mid point of the rotating axis of the rollers 58*a*.

The inventor of the present invention performed 100 hours of test operation on the following conditions. The inclination angle [the inclination angle θ of the axes M1, M2 with respect to the axis L of the drive shaft 16 (shown in FIG. 10)] of the swash plates (the first swash plate 18 and the second swash plate 51) was 18.1°, the discharge pressure was 13.5 MPa, the diameter of the cylinder bores 22 was 15.3 mm, the number of pistons 23 was nine, the number of rollers 58*a* was 36, the length of the rollers 58*a* was 6.8 mm, the diameter of the rollers 58*a* was 3 mm. When the radius of the imaginary cylinder C2 was less than the radius of the imaginary cylinder C1 by 3.4 mm (when the rollers 58*a* were displaced inward of the radial direction of the thrust bearing 58 by half the length 6.8 mm of the rollers 58*a*), flaking did not occur. However, when the radius of the imaginary cylinder C2 was less than the radius of the imaginary cylinder C1 by 4.08 mm (when the rollers 58*a* were displaced inward of the radial direction of the thrust bearing 58 by 60% of the length 6.8 mm of the rollers 58*a*), flaking occurred.

The inventor of the present invention also performed 100 hours of test operation on the above mentioned conditions for the following cases: when the radius of the imaginary cylinder C2 is greater than the radius of the imaginary cylinder C1 by 3.4 mm (when the rollers 58*a* are displaced outward of the radial direction of the thrust bearing 58 by half the length 6.8 mm of the rollers 58*a*); and when the radius of the imaginary cylinder C2 is greater than the radius of the imaginary cylinder C1 by 4.08 mm (when the rollers 58*a* are displaced outward of the radial direction of the thrust bearing 58 by 60% of the length 6.8 mm of the rollers 58*a*). When the radius of the imaginary cylinder C2 was greater than the radius of the imaginary cylinder C1 by 3.4 mm, flaking did not occur, but when the radius of the imaginary cylinder C2 was greater than the radius of the imaginary cylinder C1 by 4.08 mm, flaking occurred.

Based on the results, the configuration in which the rollers 58*a* are displaced outward or inward in the radial direction of the thrust bearing 58 by half the length of the rollers 58*a* is preferable.

It should be understood that the invention may be embodied in the following forms without departing from the spirit or scope of the invention.

(1) The first embodiment may be modified by forming, as shown by a chain double-dashed line in FIG. 2, a through hole 51*f*, which extends through the second swash plate 51 in the direction of the plate thickness, at a position of the inner circumferential portion 51*c* of the second swash plate 51 corresponding to the inner ends of the oil grooves 51*d* so that the inner ends of the oil grooves 51*d* are directly open to the crank chamber 15. With this configuration, the amount of oil introduced into the oil grooves 51*d* from the crank chamber 15 is increased, and the second swash plate 51 more reliably slides with respect to the first swash plate 18.

(2) The second embodiment may be modified such that, as shown by a chain double-dashed line in FIG. 3, through holes 51*g* formed through the first swash plate 18 in the direction of the plate thickness form the oil introducing passage.

(3) The through holes 51*e* of the second embodiment and the oil grooves 51*d* of the first embodiment may both be provided.

(4) The through holes 51*e* of the second embodiment and the through holes 51*g* shown by the chain double-dashed line in FIG. 3 may both be provided.

(5) The through holes 51*g* shown by the chain double-dashed line in FIG. 3 and the oil grooves 51*d* of the first embodiment may both be provided.

(6) In each of the embodiments, the coating 54, which is a solid lubricant, is formed on the front surface (the section 51*b*-1 and the section 51*c*-1) of the second swash plate 51. Instead, the coating 54 may be omitted and sintered metal may be sprayed to the front surface (the section 51*b*-1 and the section 51*c*-1) of the second swash plate 51. With this configuration, the front surface (the section 51*b*-1 and the section 51*c*-1) of the second swash plate 51 has minute projections and depressions formed by the sintered metal. This improves the oil retaining capability of the front surface and the friction coefficient at the sliding portion between the first swash plate 18 and the second swash plate 51 is reduced.

(7) A sliding plate that is the same as the second swash plate 51 may be provided between the first swash plate 18 and the first shoes 25A opposite to the ones that receive the reaction force of compression.

(8) The bearing that permits the first swash plate to rotatably support the second swash plate 51 need not be the ball bearing 52 used in the above embodiments, but may be, for example, a sliding bearing besides a roller bearing.

(9) The present invention may be applied to a compressor including double head pistons.

(10) The present invention need not be applied to the refrigerant compressor of the refrigeration circuit, but may be applied to, for example, an air-compressor.

Figure 6:
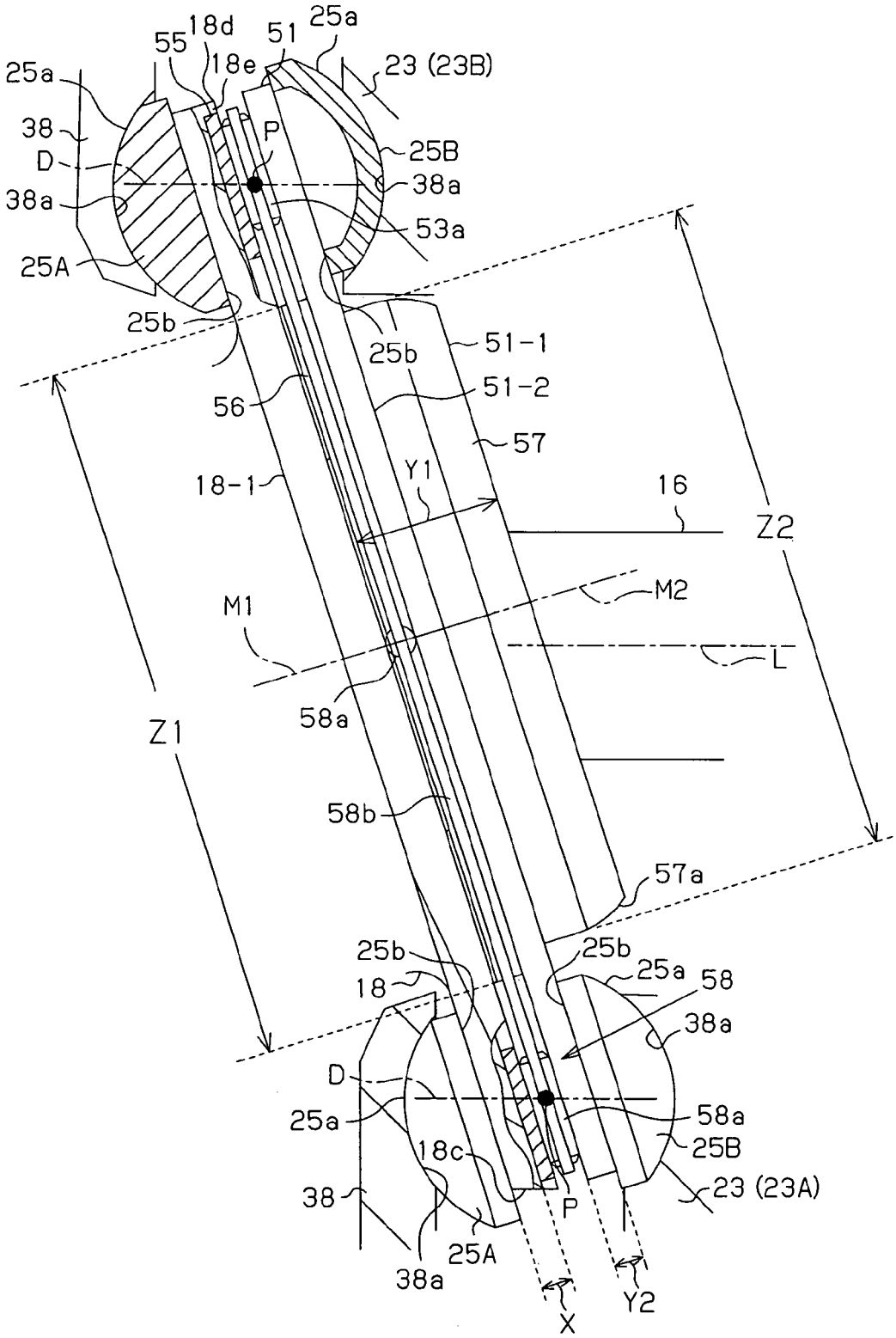
FIG. 6 is an enlarged partial view illustrating a swash plate configuration according to a fourth embodiment of the present invention.

(11) The third embodiment may be modified such that, for example, the sliding surface 25*b* of each first shoe 25A is flat as shown in FIG. 6.

(12) The fourth embodiment may be modified such that, for example, the sliding surface 25*b* of each second shoe 25B is dented at the center as shown in FIG. 6. In this case, the weight of each second shoe 25B, which reciprocates with the associated piston 23, is reduced, which reduces the inertial force of the second shoe 25B. Therefore, the inclination angle of the first swash plate 18 and the second swash plate 51, that is, the displacement of the compressor is smoothly changed.

Figure 4:
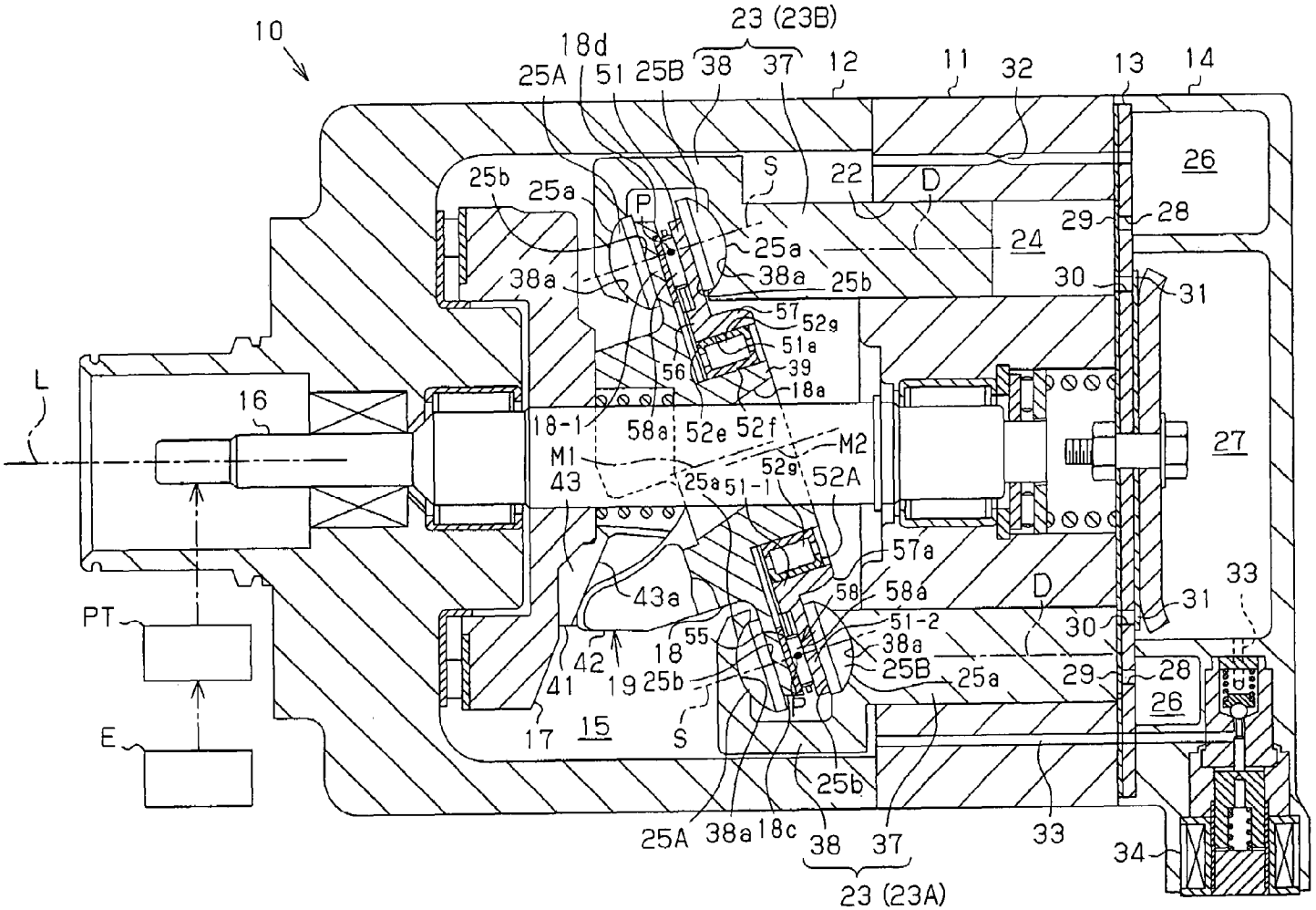
FIG. 4 is a longitudinal cross-sectional view illustrating a variable displacement swash plate compressor according to a third embodiment of the present invention.
Figure 5:
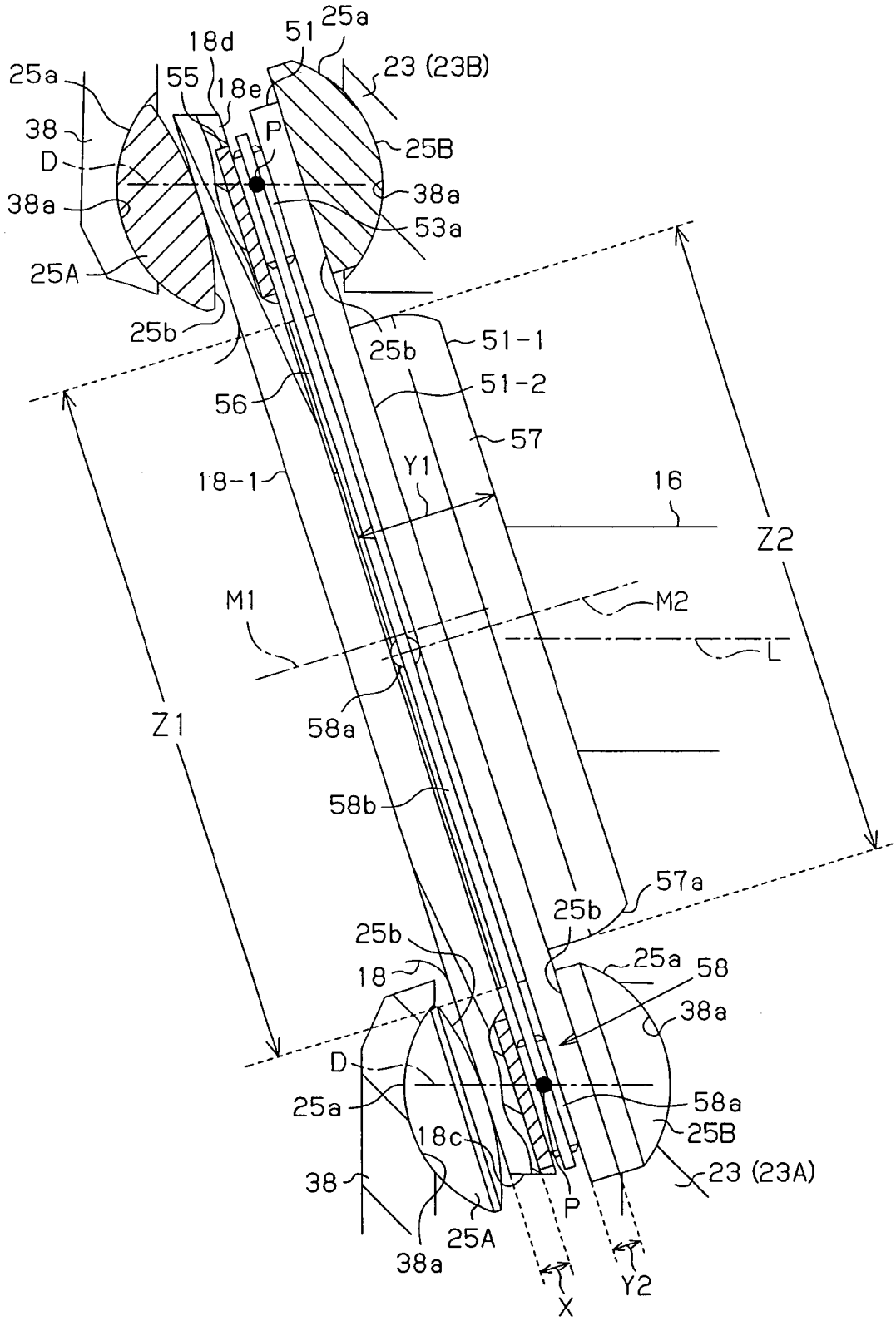
FIG. 5 is an enlarged partial view of FIG. 4 with the first and second swash plates not being sectioned (partially cut away) and part of the first and second shoes being sectioned.

(13) In the third embodiment of FIGS. 4 and 5 and the fourth embodiment of FIG. 6, the radial bearing 52A may be changed to a roller bearing, which includes balls as the rolling elements.

(14) In the third and fourth embodiments, the radial bearing 52A may be changed to a sliding bearing.

(15) In the third and fourth embodiments, the thrust bearing 58 may be changed to a roller bearing, which includes balls as the rolling elements.

(16) In the third and fourth embodiments, the thrust bearing 58 may be changed to a sliding bearing.

(17) In the third and fourth embodiments, the radial bearing 52A only receives a radial load (a load perpendicular to the axis M2) applied to the second swash plate 51. Instead, for example, the rollers 52*g* may be tilted with respect to the axis M2 of the second swash plate 51 such that the radial bearing 52A also receives a thrust load (a load along the axis M2) in addition to the radial load.

(18) In the third and fourth embodiments, the thrust bearing 58 only receives the thrust load applied to the second swash plate 51. Instead, for example, the rollers 58*a* may be tilted with respect to the surface of the second swash plate 51 such that the thrust bearing 58 also receives the radial load in addition to the thrust load.

(19) In the third and fourth embodiments, the race 55 may be omitted, and the rollers 58*a* of the thrust bearing 58 may roll directly on the first swash plate 18.

(20) In the third and fourth embodiments, the plate thickness Y1 of the inner circumferential portion 51-1 of the second swash plate 51 is thicker than the plate thickness X of the outer circumferential portion 18-1 of the first swash plate 18. However, the plate thickness Y1 of the inner circumferential portion 51-1 of the second swash plate 51 may be the same or thinner than the plate thickness X of the outer circumferential portion 18-1 of the first swash plate 18.

(21) In the second swash plate 51 of the third and fourth embodiments, the plate thickness Y1 of the inner circumferential portion 51-1 is greater than the plate thickness Y2 of the outer circumferential portion 51-2. However, the plate thickness Y1 of the inner circumferential portion 51-1 may be the same as the plate thickness Y2 of the outer circumferential portion 51-2. With this configuration, the shape of the second swash plate 51 is simplified, which facilitates manufacture of the second swash plate.

(22) In the third and fourth embodiments, the first projection 56 and the second projection 57, which form the inner circumferential portion 51-1 of the second swash plate 51, are designed such that the outer diameter Z2 of the second projection 57 is smaller than the outer diameter Z1 of the first projection 56, and the outer circumferential corner 57*a* of the distal end of the second projection is provided with the inclined surface. However, only one of the following may be employed: to make the outer diameter Z2 of the second projection 57 to be smaller than the outer diameter Z1 of the first projection 56; and to provide the inclined surface (the chamfer) on the outer circumferential corner 57*a* of the distal end face of the second projection 57. Furthermore, both of the above may not be employed. That is, if the compressor has a relatively large internal space, it is easy to increase the plate thickness Y1 of the inner circumferential portion 51-1 of the second swash plate 51 while avoiding interference between the second swash plate 51 and the pistons 23 without employing one or both of the above mentioned techniques.

(23) In the third and fourth embodiments, since the inner circumferential portion 51-1 of the second swash plate 51 includes the first projection 56 and the second projection 57, the plate thickness of the inner circumferential portion 51-1 is thicker than that of the outer circumferential portion 51-2. However, the inner circumferential portion 51-1 of the second swash plate 51 may be formed thicker than the outer circumferential portion 51-2 by providing only one of the first projection 56 and the second projection 57.

(24) In the third and fourth embodiments, the engaging portion 18*e* may be omitted, and an engaging portion may be provided on the inner circumferential portion of the first swash plate 18 (for example, the proximal portion of the support portion 39 may serve also as the engaging portion) so that the race 55 is engaged with the first swash plate 18 at the radially inward edge.

(25) In the third embodiment, the axis M2 of the second swash plate 51 is displaced in parallel from the axis M1 of the first swash plate 18 toward the center point P of the first shoe 25A and the second shoe 25B of the piston 23A located at the top dead center position. That is, the center axis M2 of the second swash plate 51 is located on a plane that is determined by the axis M1 of the first swash plate 18 and the center point P of the first and second shoes 25A, 25B corresponding to the piston 23A located at the top dead center position.

However, the configuration in which "the second swash plate is decentered with respect to the first swash plate toward the piston located at the top dead center position" is not limited to the third embodiment. That is, the center axis M2 of the second swash plate 51 may be located at any position as long as the center axis M2 is displaced, toward the piston 23A located at the top dead center position, with respect to a plane that perpendicularly intersects, at the axis M1, the plane that is determined by the axis M1 of the first swash plate 18 and the center point P of the first and second shoes 25A, 25B corresponding to the piston 23A located at the top dead center position. However, to reliably increase the contact area between the second shoe 25B of the piston 23 located in the vicinity of the top dead center position and the second swash plate 51, on the assumption that the position of the center point P of the first shoe 25A and the second shoe 25B corresponding to the piston 23A located at the top dead center position is 0° about the axis M1, the second swash plate 51 is preferably decentered from the first swash plate 18 such that the axis M2 passes through a point within a range of ±45°.

The technical ideas obtainable from the above embodiments and modified embodiments other than those disclosed in the claim section are described below with their advantages.

[1] The compressor according to claim 5, wherein a support portion, which rotatably supports the second swash plate via the bearing, projects from the first swash plate, the second swash plate is arranged with the support portion inserted in a support hole formed through the center of the second swash plate, an outer race of the bearing is press fitted in the support hole of the second swash plate.

[2] The compressor according to claim 9, wherein an engaging portion projects from the first swash plate toward the second swash plate, and the abutment between the race and the engaging portion engages the race with the first swash plate in the radial direction.

[3] The compressor according to the technical idea [2], wherein the engaging portion has an annular shape.

[4] The compressor according to any one of claims 1 to 15 and the technical ideas [1] to [3], wherein the first and second shoes each has a semispherical shape and the center of curvature points of the first and second shoes match each other, the center of curvature points being located on the axis of the associated piston, and the PCD of the thrust bearing is greater than the diameter of an imaginary cylinder defined about the axis of the first swash plate and passes through the center of curvature points of the first and the second shoes.

[5] The compressor according to any one of claims 1 to 15 and the technical ideas [1] to [3], wherein the first and second shoes each has a semispherical shape and the center of curvature points of the first and second shoes match each other, the center of curvature points being located on the axis of the associated piston, and the PCD of the thrust bearing is smaller than the diameter of an imaginary cylinder defined about the axis of the first swash plate and passes through the center of curvature points of the first and the second shoes.

[6] A swash plate compressor, wherein a first swash plate is coupled to a drive shaft to be rotatable integrally with the drive shaft, the first swash plate supports a second swash plate, pistons are coupled to the first swash plate and the second swash plate via first shoes, which abut against the first swash plate, and second shoes, which abut against the second swash plate and receive a reaction force of compression, and rotation of the drive shaft rotates the first swash plate, which causes the pistons to reciprocate and compress refrigerant gas, the compressor being characterized in that:

the second swash plate is supported by the first swash plate via a bearing to be rotatable relative to the first swash plate.

The bearing refers to at least one of a thrust bearing and a radial bearing.

The invention claimed is:

1. A swash plate compressor, comprising:

a drive shaft, a first swash plate coupled to the drive shaft to be rotatable integrally with the drive shaft, a second swash plate supported by the first swash plate, first shoes, which abut against the first swash plate, and second shoes, which abut against the second swash plate and receive a reaction force of compression, pistons coupled to the first swash plate via the first shoes and coupled to the second swash plate via the second shoes, and rotation of the drive shaft rotates the first swash plate, which causes the pistons to reciprocate and compress refrigerant gas, a thrust bearing arranged between the first shoes and the second shoes and between the outer circumferential portion of the first swash plate and the outer circumferential portion of the second swash plate, the thrust bearing supports the second swash plate to be rotatable relative to the first swash plate, and a radial bearing arranged between the inner circumferential portion of the first swash plate and the inner circumferential portion of the second swash plate, the radial bearing supports the second swash plate to be rotatable relative to the first swash plate, wherein the plate thickness of the outer circumferential portion of the second swash plate is one third or more of the plate thickness of the outer circumferential portion of the first swash plate and is thinner than the plate thickness of the outer circumferential portion of the first swash plate.

2. The compressor according to claim 1, wherein a support portion, which rotatably supports the second swash plate via the radial bearing, projects from the first swash plate, an accommodating groove, which accommodates part of the radial bearing, is formed in the first swash plate about the proximal portion of the support portion.

3. The compressor according to claim 1, wherein the friction coefficient between the first swash plate and the second swash plate is set smaller than the friction coefficient between the second shoes and the second swash plate.

4. The compressor according to claim 1, wherein the second swash plate has an annular shape, and the plate thickness of the inner circumferential portion of the second swash plate that is supported by the radial bearing is greater than the plate thickness of the outer circumferential portion of the second swash plate located between the first swash plate and the second shoes.

5. The compressor according to claim 4, wherein the plate thickness of the outer circumferential portion of the second swash plate is thinner than the plate thickness of the outer circumferential portion of the first swash plate, and the plate thickness of the inner circumferential portion of the second swash plate is thicker than the plate thickness of the outer circumferential portion of the first swash plate.

6. The compressor according to claim 4, wherein the inner circumferential portion of the second swash plate is provided with a cylindrical first projection, which projects toward the first swash plate, and a cylindrical second projection, which projects opposite to the first swash plate, so that the plate thickness of the inner circumferential portion of the second swash plate is thicker than the plate thickness of the outer circumferential portion of the second swash plate, and the outer diameter of the second projection is smaller than the outer diameter of the first projection.

7. The compressor according to claim 4, wherein the inner circumferential portion of the second swash plate is provided with a cylindrical projection, which projects opposite to the first swash plate, so that the plate thickness of the inner circumferential portion of the second swash plate is thicker than the plate thickness of the outer circumferential portion of the second swash plate, and an inclined surface is provided at the outer circumferential corner of the distal end face of the projection.

8. The compressor according to claim 1, wherein the radial bearing is formed of a roller bearing, and rollers are used as rolling elements of the radial bearing.

9. The compressor according to claim 1, wherein the thrust bearing is formed of a roller bearing, a race is located between rolling elements of the thrust bearing and the first swash plate, and the race is rotatable relative to the first swash plate.

10. The compressor according to claim 9, wherein an engaging portion projects from the outer circumferential portion of the first swash plate toward the second swash plate, the race having a radially outward edge, and the race is engaged with the first swash plate by abutting against the engaging portion at the radially outward edge of the race.

11. The compressor according to claim 10, wherein the engaging portion has an annular shape.

12. The compressor according to claim 1, wherein weight reduction holes are formed through the second swash plate extending in the direction of the plate thickness.

13. The compressor according to claim 1, wherein weight reduction recesses are formed in at least one of the front surface and the rear surface of the second swash plate.

14. The compressor according to claim 1, wherein the compressor is a variable displacement swash plate compressor in which the displacement is varied by changing the inclination angle of the first and second swash plates.

15. The compressor according to claim 1, wherein the gas is refrigerant gas used in a refrigeration circuit, and the refrigerant gas is formed of carbon dioxide.

* * * * *

UNITED STATES PATENT AND TRADEMARK OFFICE

CERTIFICATE OF CORRECTION

PATENT NO. : 7,455,008 B2
APPLICATION NO. : 10/570470
DATED : November 25, 2008
INVENTOR(S) : Hajime Kurita et al.

It is certified that error appears in the above-identified patent and that said Letters Patent is hereby corrected as shown below:

In the Specification

Column 7, lines 22-24, please delete "define a crank chamber 15. The cylinder block 11 and the front housing member 12 define the crank chamber 15. A drive shaft 16" and insert therefore -- define a crank chamber 15. A drive shaft 16 --;

Column 17, line 56, please delete "vicinity of the top dead center position, which may cause" and insert therefore -- vicinity of the top dead center position), which may cause --;

Column 19, line 54, please delete "through the mid point of the rotating axis" and insert therefore -- through the mid-point of the rotating axis --;

Column 20, line 43, please delete "through the mid point of the rotating axis" and insert therefore -- through the mid-point of the rotating axis --; and Column 23, line 59, please delete "[1] The compressor according to claim 5," and insert therefore -- [1] The compressor according to claim 4, --.

Signed and Sealed this

Twenty-third Day of June, 2009

JOHN DOLL
*Acting Director of the United States Patent and Trademark Office*